US007500635B2

(12) United States Patent
Cooper, Jr. et al.

(10) Patent No.: US 7,500,635 B2
(45) Date of Patent: Mar. 10, 2009

(54) CONTAINER FOR DISPENSING MATERIAL FROM A ROLL

(75) Inventors: Gary W. Cooper, Jr., Arlington, TX (US); Benjamin T. Nicholson, Arlington, TX (US); Patrick H. Sullins, Arlington, TX (US); Brett A. Sutton, Arlington, TX (US)

(73) Assignee: Inovar Packaging Group, LLC, Arlington, TX (US)

( * ) Notice: Subject to any disclaimer, the term of this patent is extended or adjusted under 35 U.S.C. 154(b) by 36 days.

(21) Appl. No.: 11/749,483

(22) Filed: May 16, 2007

(65) Prior Publication Data

US 2007/0267309 A1 Nov. 22, 2007

Related U.S. Application Data

(60) Provisional application No. 60/801,852, filed on May 19, 2006.

(51) Int. Cl.
*B65H 75/18* (2006.01)

(52) U.S. Cl. ..... 242/588.6; 242/594.4; 242/588.3; 206/408; 206/409

(58) Field of Classification Search ..... 242/588, 242/588.3, 588.6, 594, 594.3, 594.4, 594.5, 242/594.6; 206/389, 394, 408, 409
See application file for complete search history.

(56) References Cited

U.S. PATENT DOCUMENTS

| | | | | |
|---|---|---|---|---|
| 556,068 | A * | 3/1896 | Schloss | 242/594.3 |
| 653,211 | A * | 7/1900 | Calkins | 242/588.3 |
| 2,929,496 | A * | 3/1960 | Muehlebach et al. | 206/408 |
| 3,281,033 | A * | 10/1966 | Stutzman et al. | 206/408 |
| 3,698,600 | A * | 10/1972 | Foote | |
| 3,948,455 | A | 4/1976 | Schwartz | |
| D334,135 | S | 3/1993 | Fraker et al. | |
| 5,197,686 | A * | 3/1993 | Okada et al. | 242/594.4 |
| D334,664 | S | 4/1993 | Fraker et al. | |
| D334,883 | S | 4/1993 | Fraker et al. | |
| D335,441 | S | 5/1993 | Fraker et al. | |
| D335,816 | S | 5/1993 | Fraker et al. | |
| 5,507,386 | A * | 4/1996 | Foote | 206/409 |
| D403,575 | S | 1/1999 | Milliorn | |
| 5,950,959 | A | 9/1999 | Milliorn | |
| 6,179,244 | B1 * | 1/2001 | Rodriguez | 242/588.6 |
| D452,788 | S | 1/2002 | Neiberger et al. | |
| D454,369 | S | 3/2002 | Milliorn | |
| D462,240 | S | 9/2002 | Omdoll | |
| D471,062 | S | 3/2003 | Omdoll | |
| 6,647,096 | B1 | 11/2003 | Milliorn et al. | |
| D492,356 | S | 6/2004 | Milliorn et al. | |
| D501,225 | S | 1/2005 | Milliorn | |
| 6,991,106 | B2 | 1/2006 | Milliorn | |

(Continued)

FOREIGN PATENT DOCUMENTS

WO WO2007/137109 11/2007

OTHER PUBLICATIONS

U.S. Appl. No. 29/260,121, Gary W. Cooper, Jr., et al.

(Continued)

*Primary Examiner*—William A Rivera
(74) *Attorney, Agent, or Firm*—Haynes and Boone, LLP

(57) ABSTRACT

A container for dispensing material from a roll is described.

22 Claims, 14 Drawing Sheets

U.S. PATENT DOCUMENTS

| | | | |
|---|---|---|---|
| D517,122 | S | 3/2006 | Milliorn |
| D556,831 | S | 12/2007 | Cooper et al. |
| D568,048 | S | 5/2008 | Cooper et al. |
| D568,049 | S | 5/2008 | Cooper et al. |
| D573,619 | S | 7/2008 | Pearl et al. |

OTHER PUBLICATIONS

U.S. Appl. No. 60/801,852, Gary W. Cooper, Jr., et al.
U.S. Appl. No. 29/272,704, filed Feb. 15, 2007, Gary W. Cooper, Jr., et al.
Daydots Food Safety Solutions; Summer 2003; pp. 1, 2, 26, 32, 33, 64.
Dot-It Food Rotation & Custom Labels; May 15, 2005; pp. 2, 4-7, 12-16, 18, 19.
International Searching Authority, "International Search Report," Sep. 5, 2008, 3 pgs., International Application No. PCT/US07/69119; International Searching Authority/US.
International Searching Authority, "Written Opinion," Sep. 5, 2008, 3 pgs., International Application No. PCT/US07/69119; International Searching Authority/US.

* cited by examiner

CONTAINER FOR DISPENSING MATERIAL FROM A ROLL

CROSS REFERENCE TO RELATED APPLICATIONS

This application claims the benefit of the filing date of U.S. provisional patent application Ser. No. 60/801,852, filed on May 19, 2006, the disclosure of which is incorporated herein by reference.

This application is related to the following applications: (1) U.S. provisional patent application Ser. No. 60/801,852, filed on May 19, 2006; (2) U.S. patent application Ser. No. 29/260,121, filed on May 19, 2006; and (3) U.S. patent application Ser. No. 29/272,704, filed on Feb. 15, 2007, the disclosures of which are incorporated herein by reference.

BACKGROUND

The present disclosure relates in general to containers and in particular to containers for storing one or more rolls comprising a material wound on a core, and dispensing the material from the roll.

SUMMARY

According to one aspect of the present disclosure, a container is provided that includes a cavity defined by a top member and a bottom member, which top member and bottom member are attached for pivotal movement about an axis; wherein the bottom member comprises first and second walls extending generally parallel to the axis; and a shelf extending from the second wall in a plane generally perpendicular to the second wall and generally parallel to the axis; wherein the top member comprises a lip extending over a portion of the shelf; and at least one divider disposed within the cavity and extending between the first and second walls generally perpendicular to the axis, and comprising a projection extending from the divider over at least a portion of the shelf and comprising a top edge in contact with at least a portion of the lip.

According to another aspect of the present disclosure, a kit is provided that includes a container comprising a cavity defined by a top member and a bottom member, which top member and bottom member are attached for pivotal movement about an axis; wherein the bottom member comprises first and second walls extending generally parallel to the axis; and a shelf extending from the second wall in a plane generally perpendicular to the second wall and generally parallel to the axis; wherein the top member comprises a lip extending over a portion of the shelf; and at least one divider comprising at least one spindle extending from the divider; and a projection extending from the divider, wherein the projection comprises a top edge; and a bottom edge; wherein the at least one divider is adapted for disposal within the cavity such that the at least one divider extends between the first and second walls generally perpendicular to the axis, and wherein the projection is adapted to extend from the divider over at least a portion of the shelf, and the adaptation is such that the top edge is in contact with at least a portion of the lip, and the bottom edge is in contact with the shelf.

According to another aspect of the present disclosure, a method is provided that includes providing a container comprising a base and a lid coupled thereto; removably engaging a first roll of material with a first divider; removably engaging the first divider with the base; and dispensing material from the first roll of material after removably engaging the first roll of material with the first divider and removably engaging the first divider with the base.

According to another aspect of the present disclosure, a container for dispensing material from a roll comprising a core defining an internal passage is provided that includes a base; a lid coupled to the base; a first divider removably engaged with the base, the first divider comprising a wall; and at least one spindle extending from the wall and adapted to extend in the internal passage defined by the core of the roll.

According to another aspect of the present disclosure, a system is provided that includes means for providing a container comprising a base and a lid coupled thereto; means for removably engaging a first roll of material with a first divider; means for removably engaging the first divider with the base; and means for dispensing material from the first roll of material after removably engaging the first roll of material with the first divider and removably engaging the first divider with the base.

BRIEF DESCRIPTION OF THE DRAWINGS

The disclosure can be more clearly understood by reference to the following drawings, which illustrate exemplary embodiments thereof, and which are not intended to limit the scope of the appended claims.

The disclosure can be more clearly understood by reference to some of its exemplary embodiments, described in detail below, which description is not intended to limit the scope of the claims in any way.

DETAILED DESCRIPTION

Figure 1:
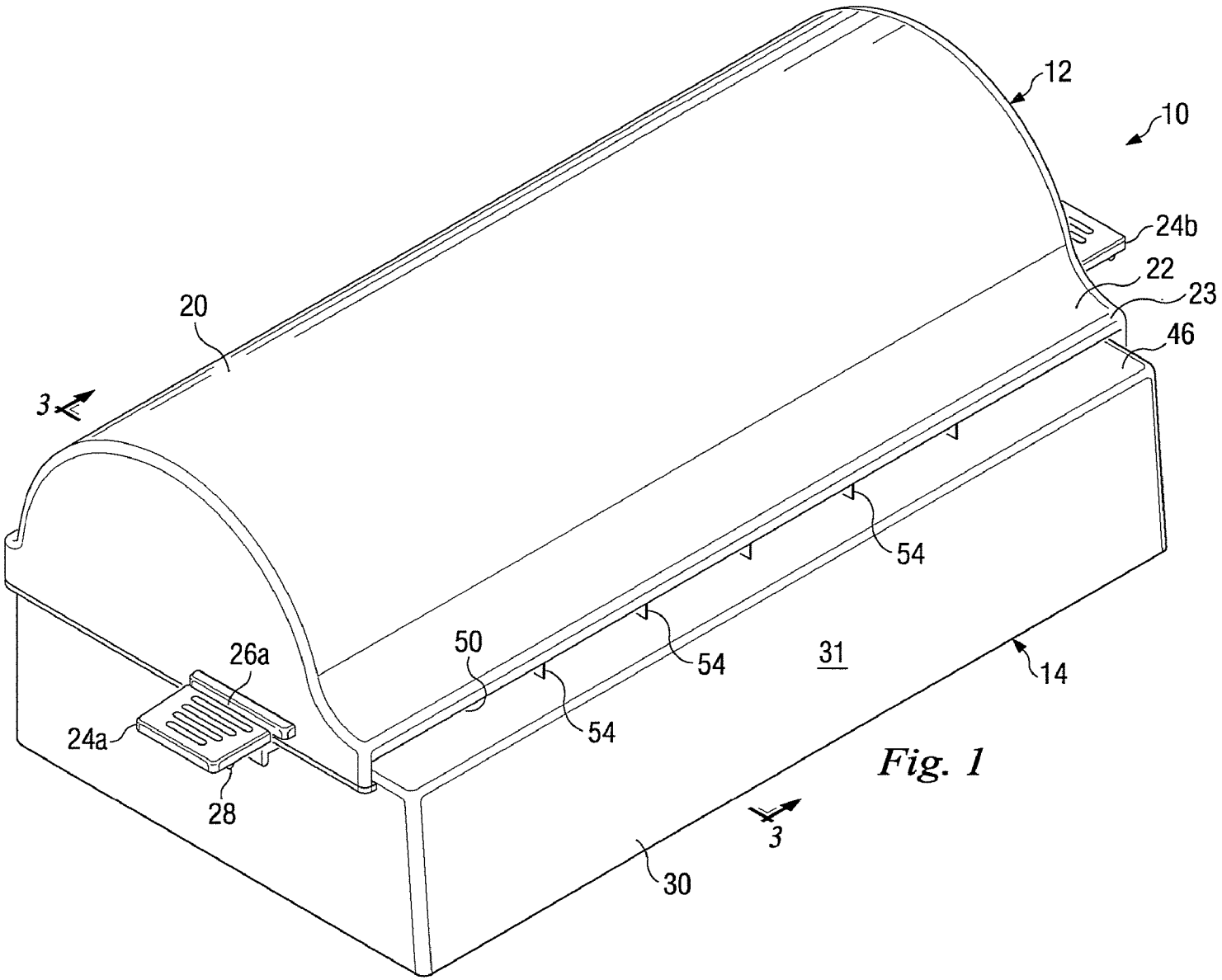
FIG. 1 is a perspective view of the front of an exemplary embodiment of a container.
Figure 2:
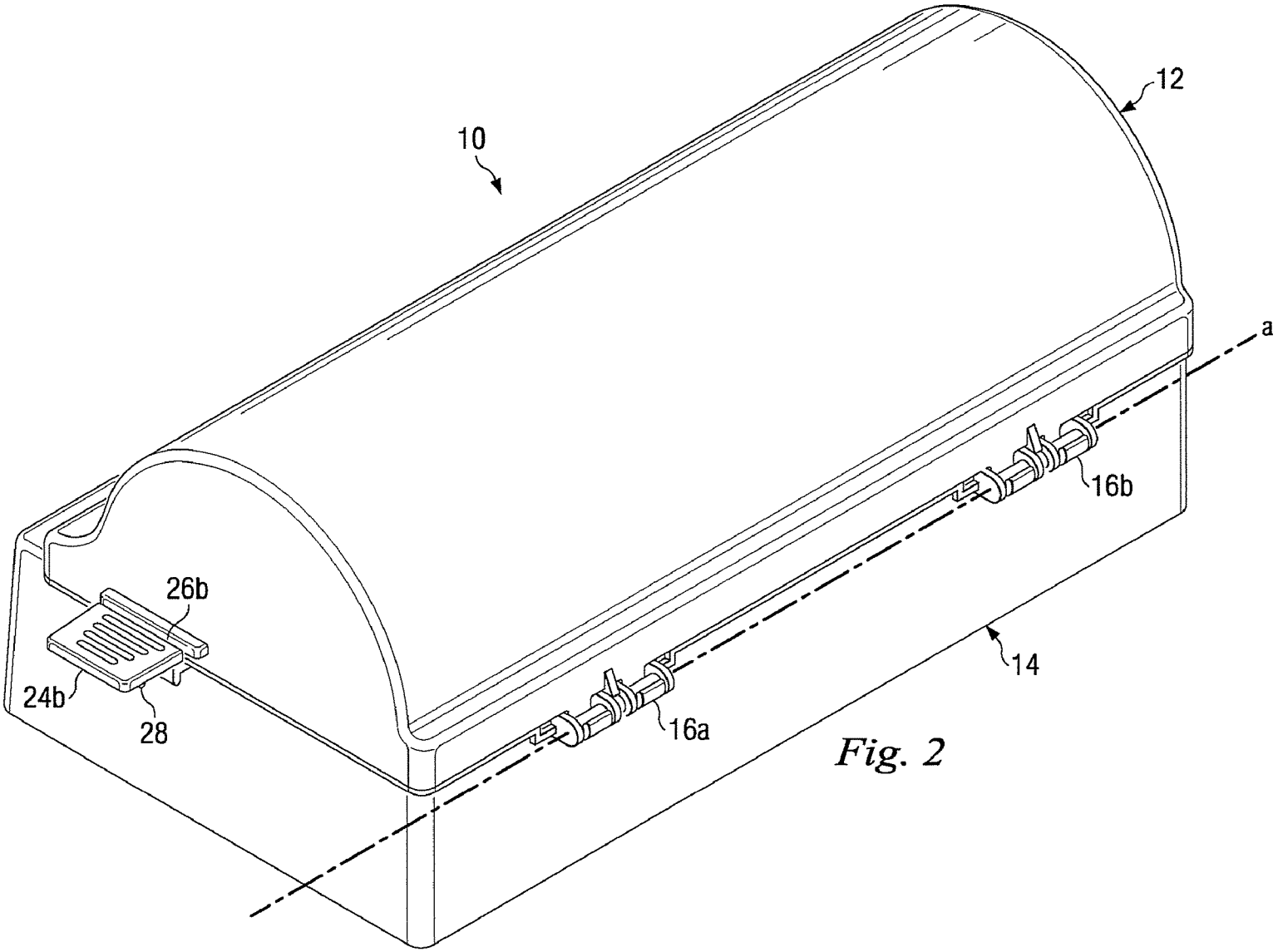
FIG. 2 is a perspective view of the back of the container illustrated in FIG. 1.
Figure 3:
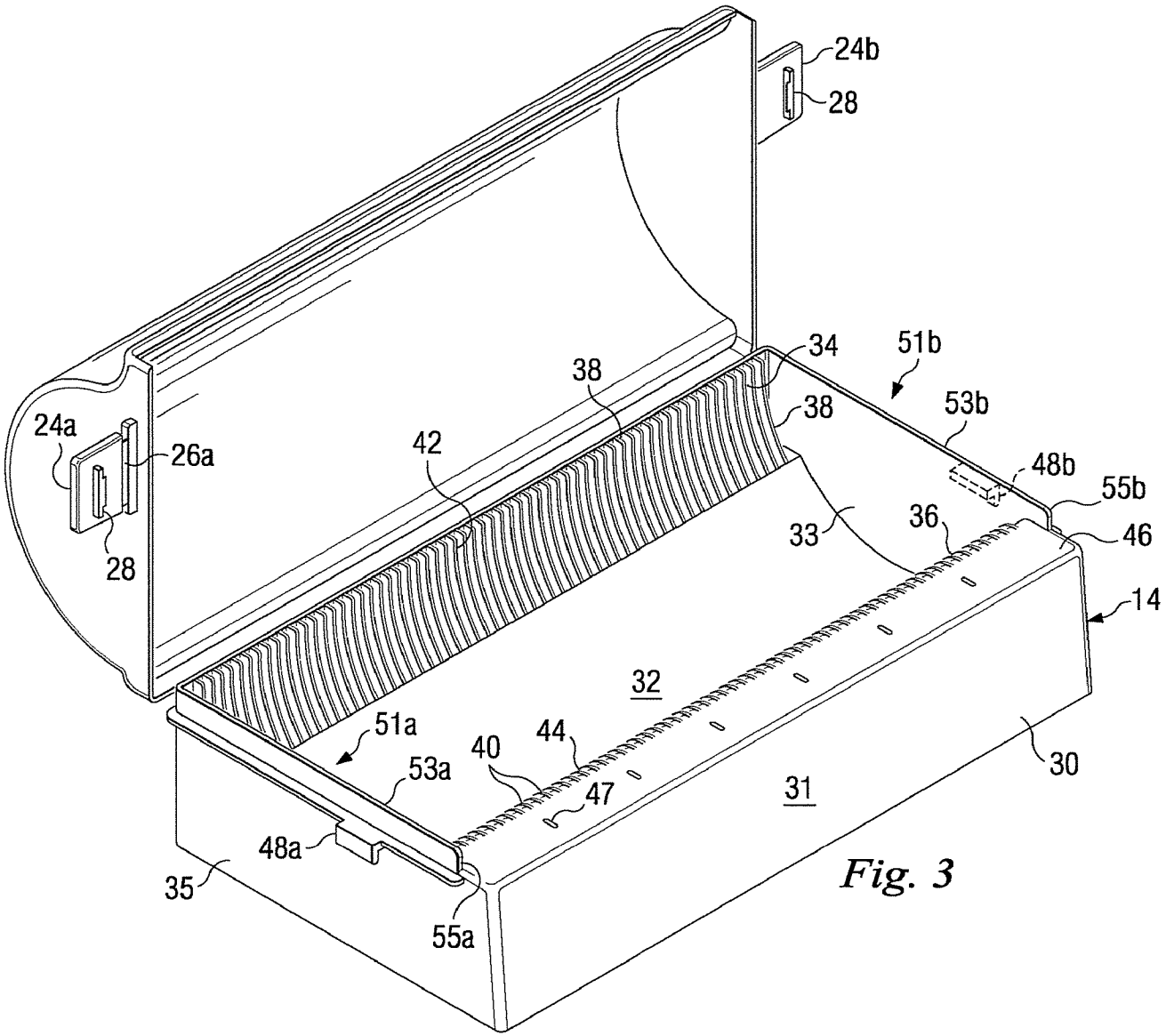
FIG. 3 is a perspective view of the container illustrated in FIG. 1, in an open position.
Figure 4A:
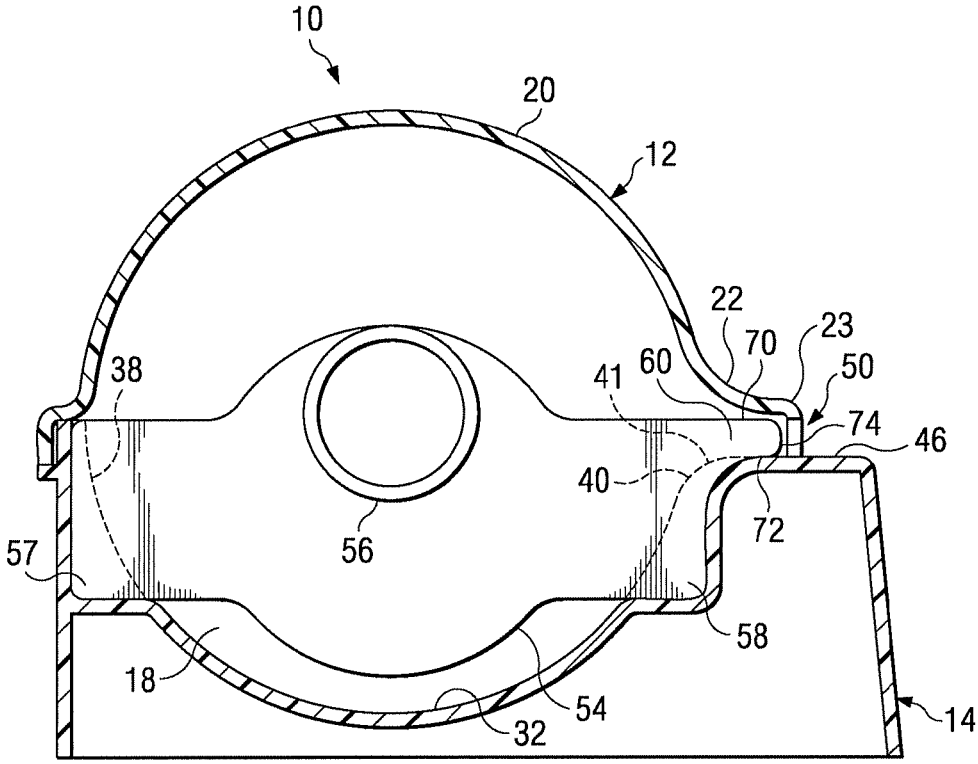
FIG. 4*a* is a sectional view of the container illustrated in FIG. 1, taken along line 3-3 in FIG. 1.
Figure 4B:
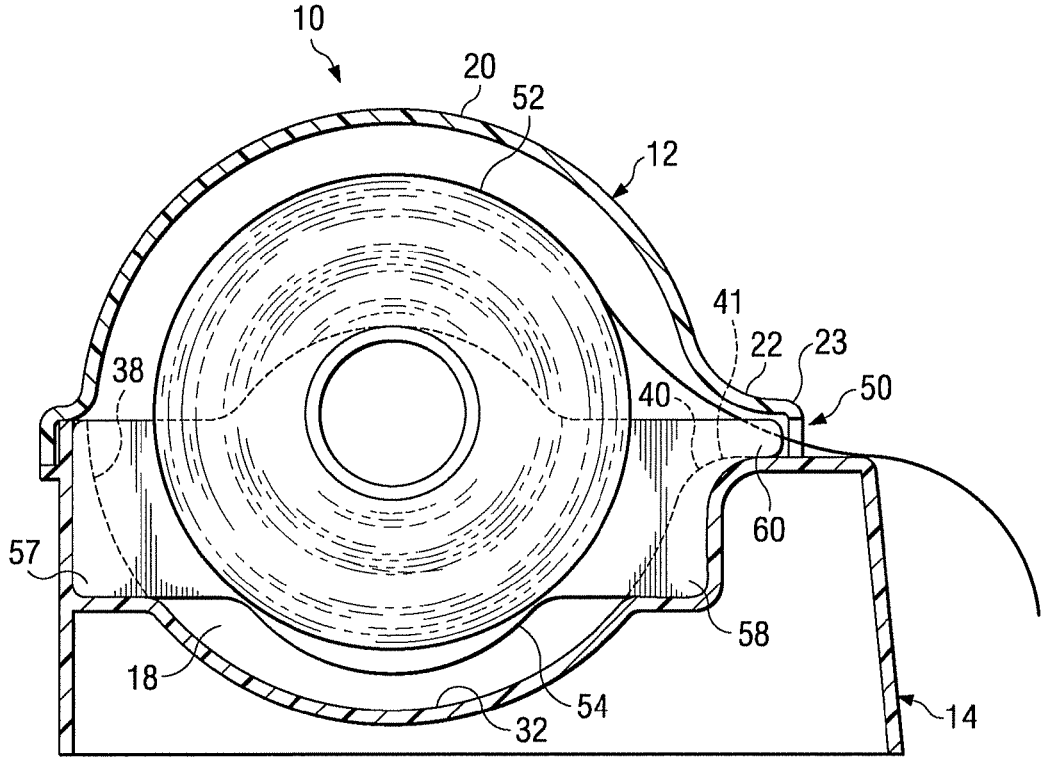
FIG. 4*b* is a view similar to that of FIG. 4*a*, but depicting a roll stored in the container.
Figure 5:
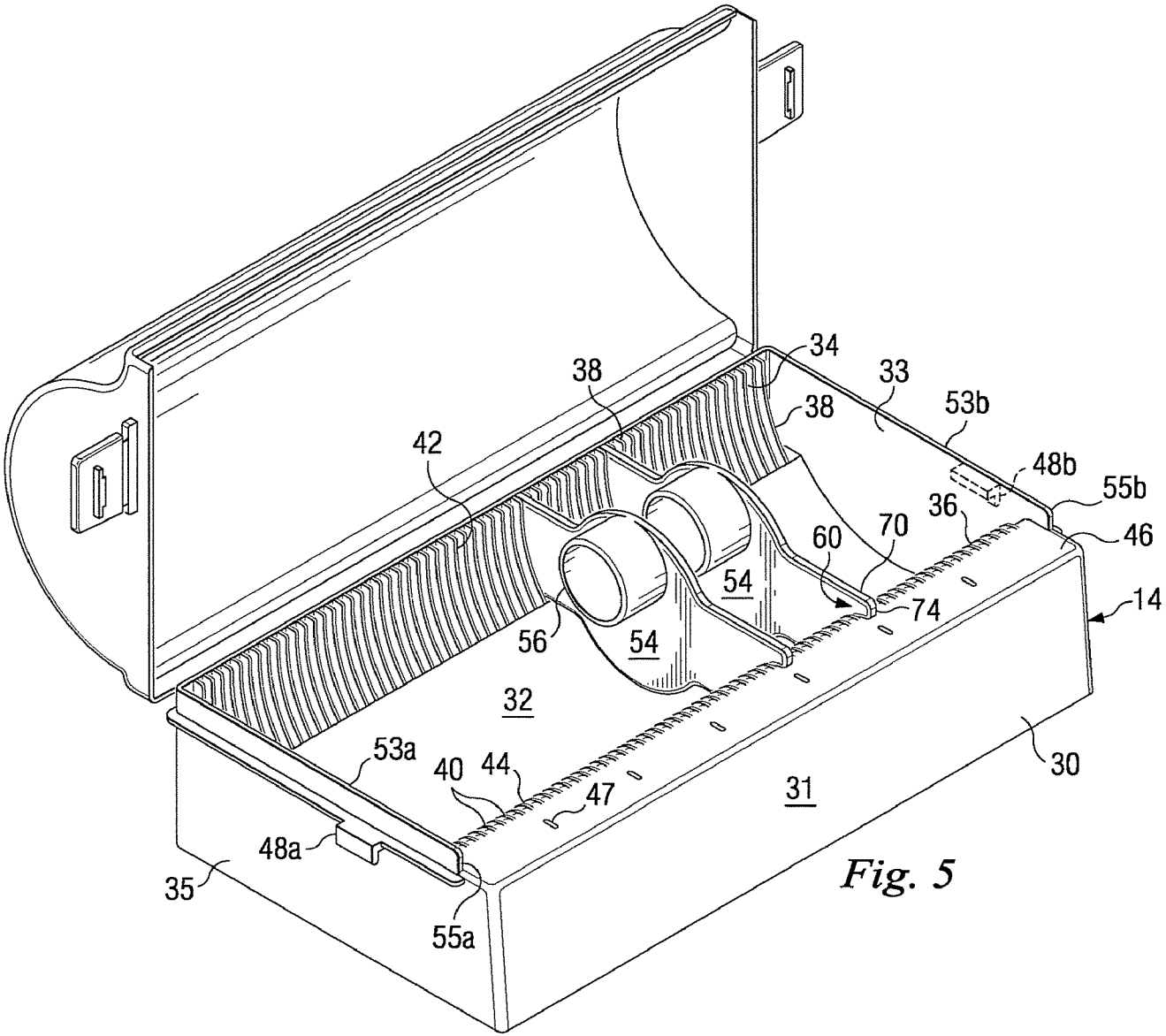
FIG. 5 is a perspective view of the container illustrated in FIG. 1, in an open position and with dividers according to an exemplary embodiment disposed therein.

In an exemplary embodiment, as illustrated in FIGS. 1-5, a container 10 has a top member 12 pivotally connected to a bottom member 14 about an axis a. The top member 12 and the bottom member 14 pivot about axis a such that the container 10 can be opened (as illustrated in FIGS. 3 and 5) and closed (as illustrated in FIGS. 1 and 2). In the closed position, the top member 12 and the bottom member 14 define a cavity 18 for storing rolls 52.

In the exemplary embodiment illustrated in FIGS. 1-5, the cavity 18 is generally cylindrically shaped, and the top member 12 and the bottom member 14 are pivotally connected by hinges 16*a* and 16*b*.

In an exemplary embodiment, as illustrated in FIG. 3, the bottom member 14 includes a body 30 having a front 31 and a generally semi-cylindrically-shaped inner surface 32. In other embodiments, the inner surface of the body 30 could be other than semi-cylindrical. The body 30 further includes a first wall 34 and a second wall 36, each of which extends longitudinally parallel to the axis a, and which define facing sides of the bottom member 14. Third wall 33 and fourth wall 35 extend between the first and second walls 34, 36 perpendicular to the axis a, and define enclosing sides of the bottom member 14. A shelf 46 extends between the second wall 36 and the front 31 of the body 30, in a plane perpendicular to the second wall 36, and parallel to the axis a.

The walls 34 and 36 have a plurality of extensions 38 and 40, respectively, defined thereon. Adjacent extensions on each of the first and second walls 34, 36 form a plurality of grooves 42 and 44, respectively. The extensions 38 and 40 are positioned on their respective walls so as to define pairs of corresponding facing grooves. The extensions 38 formed on the wall that is proximal to hinges 16*a* and 16*b* (which in the embodiment illustrated in FIG. 3 is the first wall 34) have a curvature that corresponds with the cylindrical shape of the cavity 18. The extensions 40 formed on the wall that is distal to hinges 16*a* and 16*b* (which in the embodiment illustrated in FIG. 3 is the second wall 36) are also curved to correspond with the cylindrical shape of the cavity 18. In addition, the extensions 40 extend over at least a portion of the shelf 46 so as to define a rounded edge 41 thereon. In embodiments where the cavity 18 has a shape other than cylindrical, the extensions 38 and 40 will be shaped so as to facilitate the rotational movement needed to pull material from one or more of the rolls 52.

Each wall 33 and 35 has a ridge 51*a* and 51*b*, respectively, extending upwardly therefrom, and outwardly over a portion of the shelf 46. Each ridge 51*a* and 51*b* has a top rim 53*a* and 53*b*, respectively, and terminates over a portion of the shelf 46 at a front face 55*a* and 55*b*, respectively. The front faces 55*a* and 55*b* span a gap 50 between the shelf 46 and a lip 22 of the top member 12, which are described further herein. Also, the ridges 51*a* and 51*b* support the rolls 52 stored in the container 10 in a manner similar to that which will be described with respect to FIGS. 4*a* and 4*b*.

The top member 12 includes a body 20 and a lip 22, which extends from the body 20 over a portion of the shelf 46, and terminates at an edge 23 that is spaced apart from the shelf so as to define a gap 50 between the lip 22 and the shelf 46. As illustrated in FIG. 4*b*, when a roll 52 is stored in the container 10, material can be dispensed from the roll through the gap 50.

In the embodiment illustrated in FIGS. 1-5, the body 20 of the top member 12 has generally semi-cylindrically shaped inner and outer surfaces, and the lip 22 is generally fillet-shaped, extending generally parallel to the axis a. The inner surface of the body 20 defines an upper part of cavity 18 in the container 10. In other embodiments, one or both of the inner and outer surfaces of the body 20 could be other than semi-cylindrical.

The top member 12 also includes tabs 24*a* and 24*b*, which are pivotally connected to the top member 12 about parallel axes perpendicular to the axis a. In the embodiment illustrated in FIGS. 1-5, the tabs 24*a* and 24*b* are attached to the outer surface of the top member 12 by hinges 26*a* and 26*b*. Each of the tabs 24*a* and 24*b* includes a lip 28 located on the bottom of the tabs.

Referring again to FIG. 3, the bottom member 14 includes locks 48*a* and 48*b*, which are attached to the bottom member 14 in a position so as to engage the respective lips 28 of the tabs 24*a* and 24*b* when the container 10 is in a closed position. Engaging the lips 28 with the locks 48*a* and 48*b* generally prevents the opening of the container 10. In other embodiments, the tabs 24*a* and 24*b* are attached to the bottom member 14 of the container 10, and the locks 48*a* and 48*b* are attached to the top member 12. According to such an embodiment, the lips 28 would be positioned on the top of the tabs 24*a* and 24*b*. The tabs 24*a* and 24*b*, the lips 28, and the locks 48*a* and 48*b* provide a simple and easy means for opening the container 10 so that rolls stored therein can be replaced, and for preventing the container 10 from opening unexpectedly and spilling the rolls stored therein. Other suitable means could include Velcro closure or snap closure.

Referring now to FIGS. 4*a*, 4*b* and 5, at least one divider 54 is disposed within the cavity 18. The divider 54 has a first edge 57 and a second edge 58, which are removably engaged within corresponding facing grooves 42 and 44, respectively. The divider 54 has at least one spindle or axle 56 positioned thereon so as to extend from the divider 54 in a direction that is generally parallel to the axis a. As illustrated in FIG. 4*b*, a roll 52 is positioned on the axle 56. In an embodiment where the inner surface of the bottom member 14 has a shape that would interfere with the rotation of the roll about the axle 56 that occurs when material is dispensed from the roll, the axle 56 is positioned on divider 54 such that roll 52 does not contact the inner surface. In the embodiment illustrated in FIGS. 1-5, in which the inner surface of the bottom member has a generally semi-cylindrical shape, contact between the roll and the inner surface is acceptable, but the axle 56 is located on the divider 54 so that such contact is minimal or non-existent may be preferred.

The divider 54 can have any shape that could be accommodated by the physical dimensions of the container 10. In several exemplary embodiments, a plurality of rolls will be stored in the container 10, and held in place therein by a plurality of the dividers. According to some such embodiments, the dividers have a shape so as to maintain separation between the rolls, and to support the sides of the rolls.

The axle 56 helps to hold the roll 52 in place within the container 10 such that movement of the roll 52 is substantially limited to the rotation of the roll 52 about the axle 56, which rotation occurs as material is dispensed from the roll. Dispensing material from the roll 52 can cause the core of the roll 52 to migrate or move such that the material dispensed from one roll 52 is dispensed along a path that intersects with the path of material being dispensed from another roll 52 in the container 10, thereby causing the material to jam. The axle 56 reduces the potential for such jamming by holding the respective roll 52 in place.

In addition, it is noted that rolls comprised of material wound on a core that does not have supporting sides such as, for example, a roll of adhesive labels, tend to shift forward when a user pulls the material through the gap in the container. This forward shifting of the roll causes the roll to jam against the inside of the container. As material is dispensed from the roll, the diameter of the roll decreases, and the jamming problems tend to increase. The axle 56 reduces the tendency of the roll 52 to shift forward, thereby reducing the potential for jamming.

In another embodiment of the container 10, the divider 54 does not have an axle 56. Such an embodiment would be particularly useful with rolls comprising material wound on a core with supporting sides, such as a spool. For example, a spool of ribbon may be placed in a container such as the container 10, and the supporting sides on the spool would serve to keep the roll from shifting forward inside the container, generally achieving the same result that the axle 56 achieves for rolls without supporting sides.

An additional effect of the axle 56 is to reduce movement of a roll when container 10 is in a position that would dispense material in a direction other than generally parallel with respect to the ground. For example, if the container is mounted on a wall such that material dispensed therefrom would be dispensed in a direction generally perpendicular with respect to the ground, the axle 56 helps to hold the rolls in place within the container, even when the container is in an open position. As another example, if an open container fell from a countertop, the axle 56 helps to hold the rolls in place within the container.

Because the divider 54 is removably engaged within grooves 42, 44, the divider 54 can be removed from the cavity 18 by simply pulling it out. Thus, when a roll of material needs to be replaced or refilled, the divider holding that roll can be removed and the roll replaced, without the need to remove any other rolls held in the container.

In addition, the divider 54 can be positioned within any pair of corresponding grooves 42 and 44 within the cavity 18, and therefore the container 10 can be configured to store rolls in a variety of sizes. In one embodiment, the shelf 46 may have markings 47, which are spaced so as to guide placement of a divider 54 for accommodating a roll of a certain size.

The divider 54 has a projection 60 extending from the second edge 58 over at least a portion of the shelf 46. The projection 60 has a top edge 70, a bottom edge 72 and a facing edge 74.

The top edge 70 is proximate or in contact with at least a portion of the top member lip 22 proximal to the terminal edge 23 of the lip 22. In several exemplary embodiments, the top edge 70 may be proximate or in contact with the terminal edge 23, and/or the lip 22. The bottom edge 72 is in contact with the shelf 46.

The facing edge 74 terminates proximal to the terminal edge 23 of the lip 22, and in some embodiments, may terminate so as to be in contact with the terminal edge 23. The facing edge 74 has a lower portion that spans the gap 50 between the shelf 46 and the lip 22, and therefore defines one side of a portal in the gap 50. The other side of the portal can be defined by any of ridge 51*a*, ridge 51*b*, or the facing edge 74 of an adjacent divider 54. The portal serves to guide material being dispensed from the container 10 through the gap 50.

In addition, the extension of the ridges 51*a*, 51*b* and the projection 60 over at least a portion of the shelf 46, and the spanning of the front faces 55*a* and 55*b*, and the facing edge 74 between the shelf 46 and the lip 22, prevents material from being dispensed through the gap 50 in an area other than the defined portal. For example, in an embodiment where a plurality of rolls are being stored in the container 10, it could be desirable to dispense material from one roll without interference from adjacent roll(s), and to prevent material being dispensed through a portal in gap 50 from becoming intertwined with material being dispensed through an adjacent portal. According to such an embodiment, the top, bottom and facing edges of the projection 60 operate to keep the material in its corresponding portal, and prevent the material from crossing over into an adjacent portal.

Figure 6A:
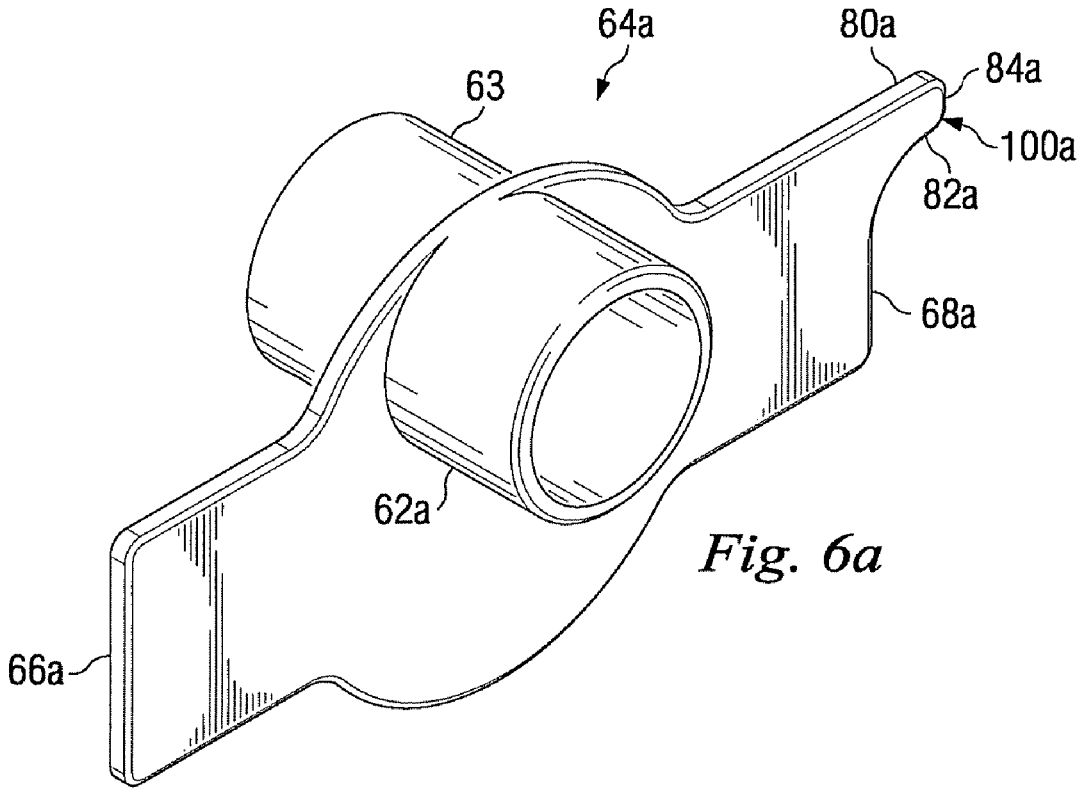
FIGS. 6*a* and 6*b* are perspective views of exemplary embodiments of dividers suitable for use with the container illustrated in FIG. 1.
Figure 6B:
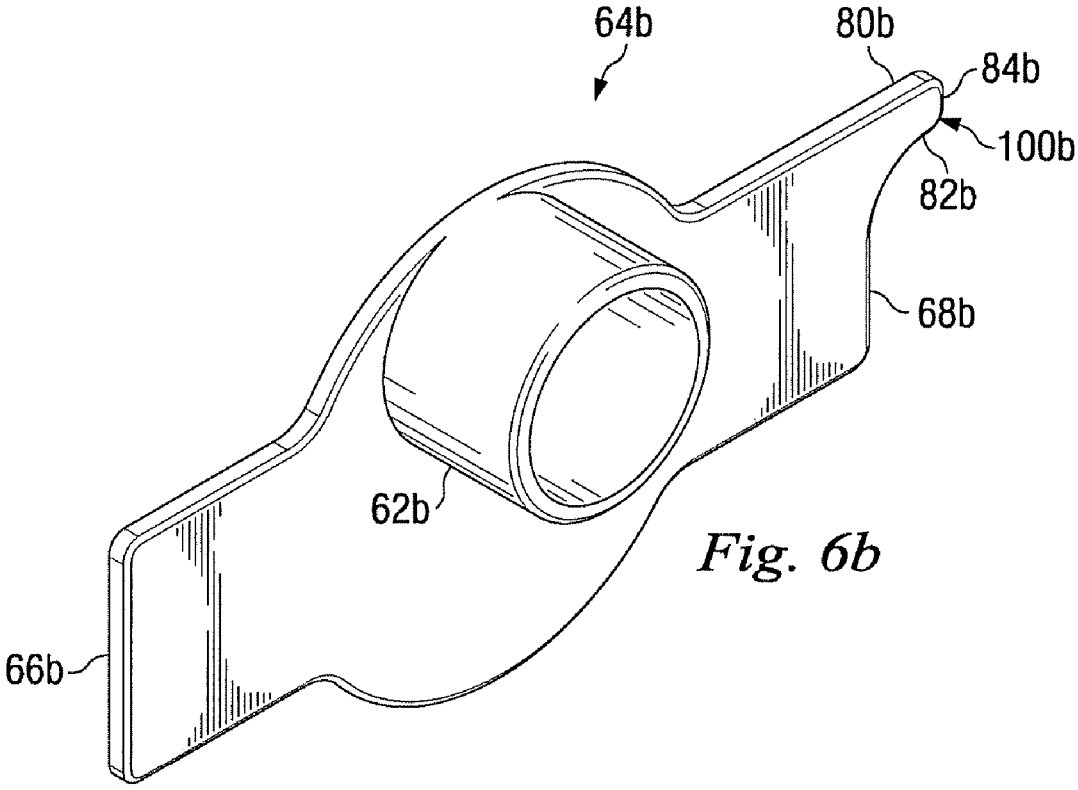

FIGS. 6*a* and 6*b* illustrate exemplary configurations for the dividers 54. In FIGS. 6*a* and 6*b*, each of dividers 64*a* and 64*b* have a first edge 66*a* and 66*b*, a second edge 68*a* and 68*b*, and projections 100*a* and 100*b*, respectively. The projections 100*a* and 100*b* each have a top edge 80*a*, 80*b*, a bottom edge, 82*a*, 82*b*, and a facing edge 84*a*, 84*b*, respectively.

The divider 64*a* has spindles or axles 62*a* and 63 positioned on opposing sides thereof so as to extend from the divider 64*a* in a direction that would be generally parallel with respect to the axis a of a container. The divider 64*b* has a spindle or axle 62*b* positioned thereon so as to extend from the divider 64*b* in a direction that would be generally parallel with respect to the axis a of a container.

The container 10 can be sized and provided with the grooves 42 and 44 so as to accommodate a plurality of dividers 54 for a varying numbers of rolls and a variety of sizes. For example, seven rolls of labels, each label bearing a day of the week, could be accommodated in the container 10 with a divider configuration comprising five one-axle dividers, such as illustrated in FIG. 6*b*, and one two-axle divider, such as illustrated in FIG. 6*a*.

Figure 7:
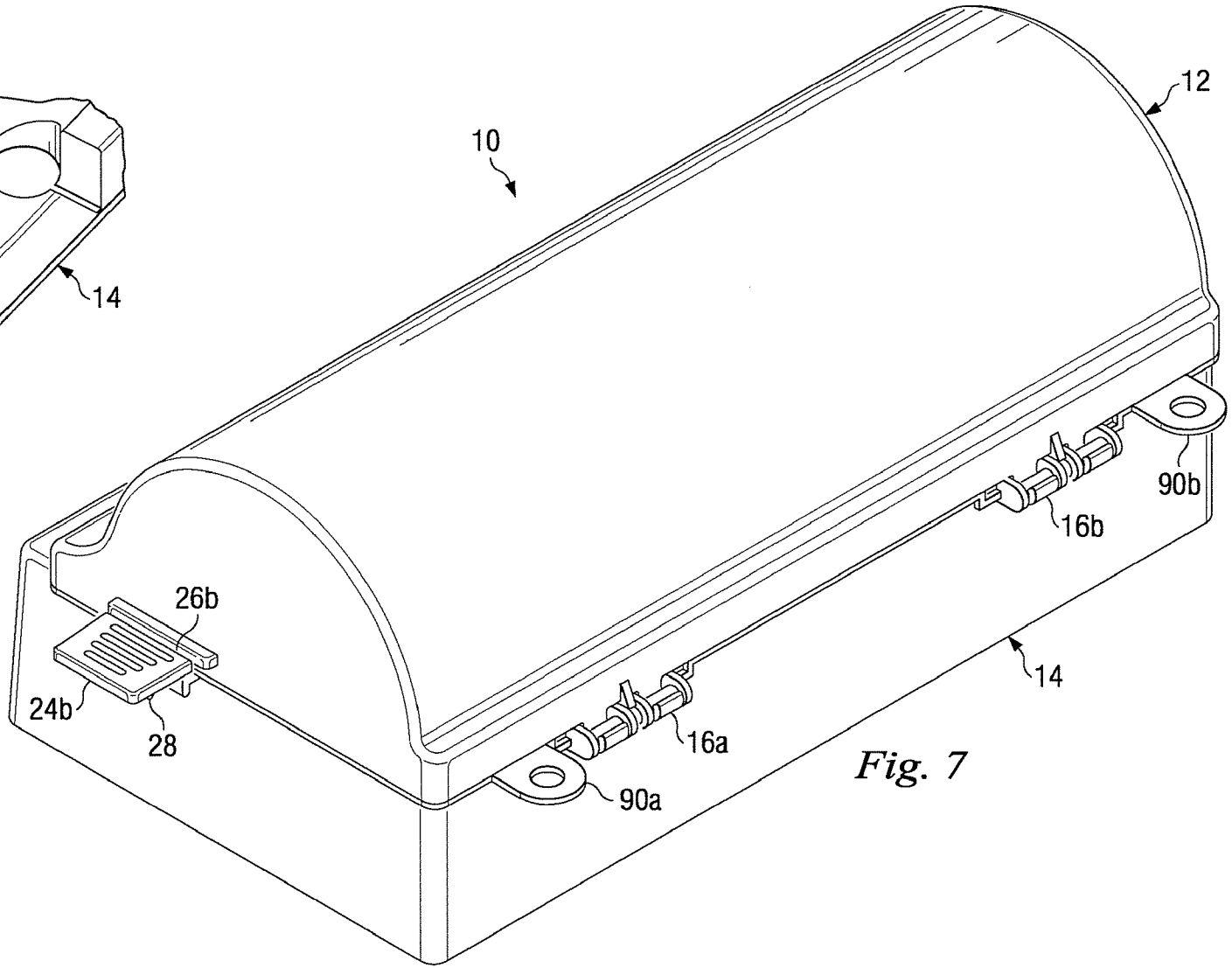
FIG. 7 is a perspective view of an alternate embodiment of the container illustrated in FIG. 2.

The container 10 can be mounted on a wall, cabinet, or any vertical surface by a variety of methods. One suitable method is illustrated in FIG. 7. As illustrated in FIG. 7, the container 10 further comprises mounting means 90*a* and 90*b*, which are spaced longitudinally along axis a. In the embodiment illustrated in FIG. 7, the mounting means 90*a* and 90*b* could be referred to as slotted tabs. The mounting means 90*a* and 90*b* can be located on either the top member 12 or the bottom member 14. Using the mounting means 90*a* and 90*b*, the container 10 can be hung on a wall, cabinet, or any vertical surface with nails, hooks, pegs and the like.

Figure 8:
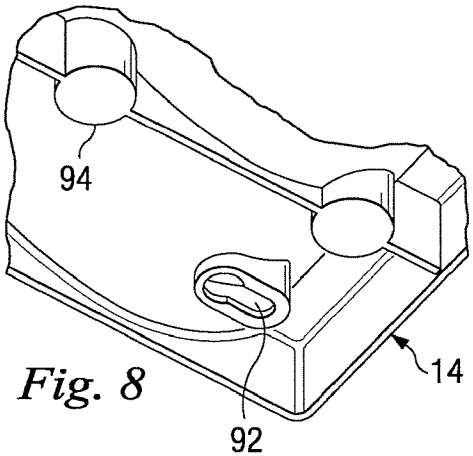
FIG. 8 is a perspective cut-away view of additional optional features of a container as described herein.

Referring now to FIG. 8, another suitable method for mounting the container 10 is illustrated. According to the embodiment illustrated in FIG. 8, the inner surface of the bottom member body 30 comprises mounting means 92, which in the embodiment illustrated in FIG. 8 could be referred to as slots. Using the mounting means 92, the container 10 can be hung on a wall, cabinet, or any vertical surface with nails, hooks, pegs and/or the like.

The container 10 can also be simply carried from one work station to another work station or area. FIG. 8 also illustrates features for such an embodiment. As illustrated in FIG. 8, the bottom member 14 comprises frictional areas 94 on its bottom surface. The frictional areas 94 provide traction so that if the container 10 is placed on a table, counter top, or other flat work space, the potential for the container 10 to slide or move around is minimized.

Figure 9:
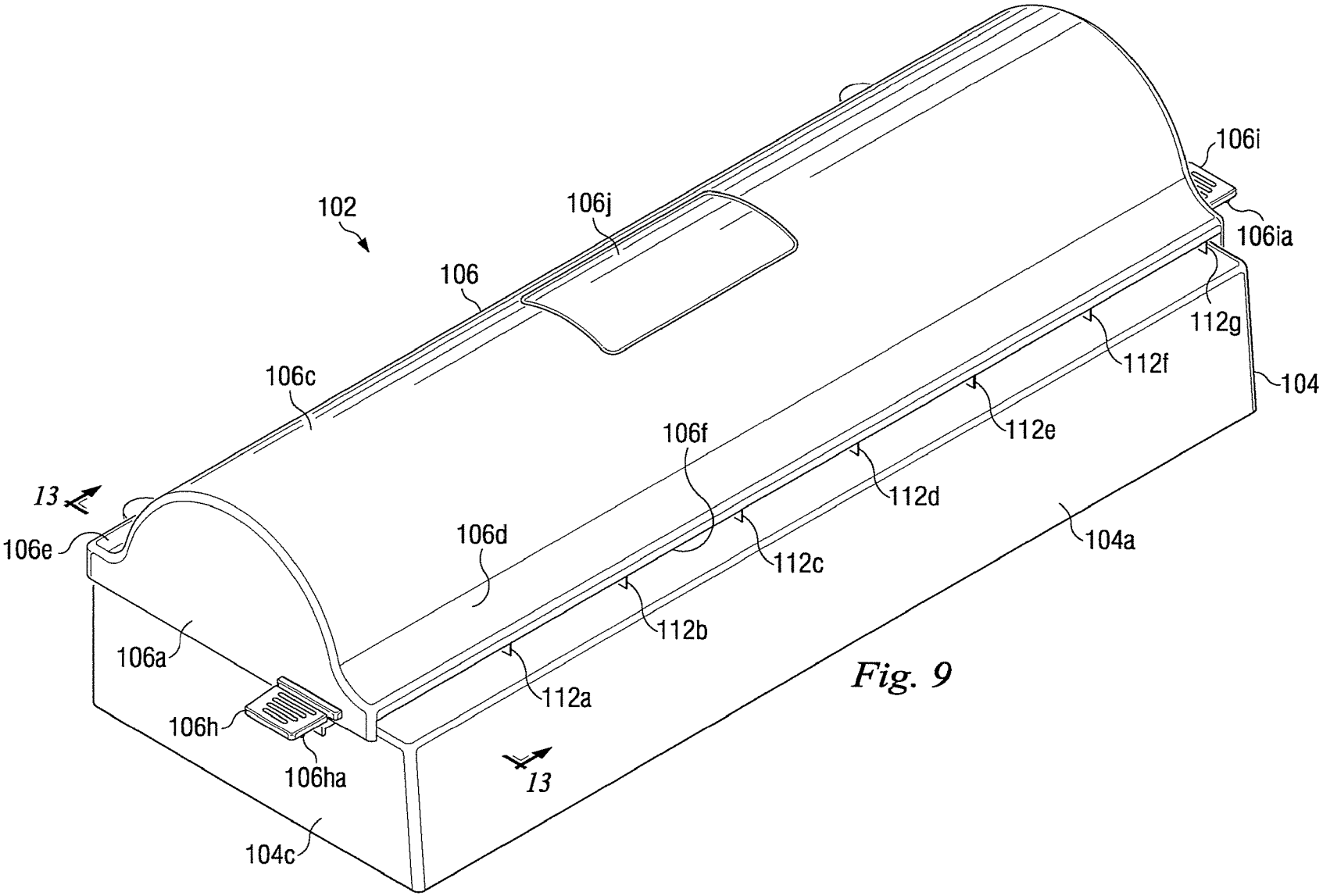
FIG. 9 is a perspective view of a container according to yet another exemplary embodiment, the container including a base and a lid hingedly coupled thereto.
Figure 10:
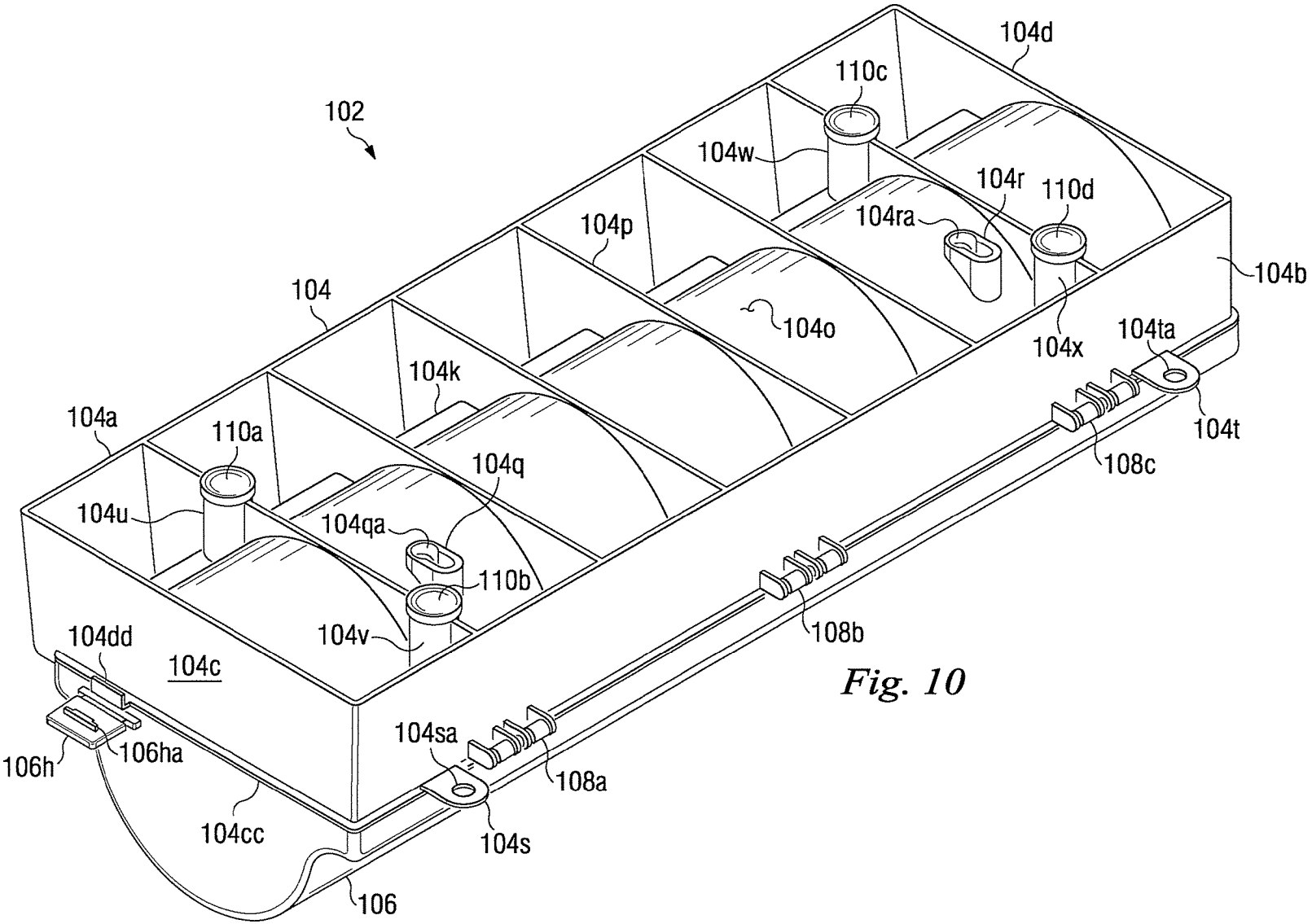
FIG. 10 is another perspective view of the container of FIG. 9.
Figure 11:
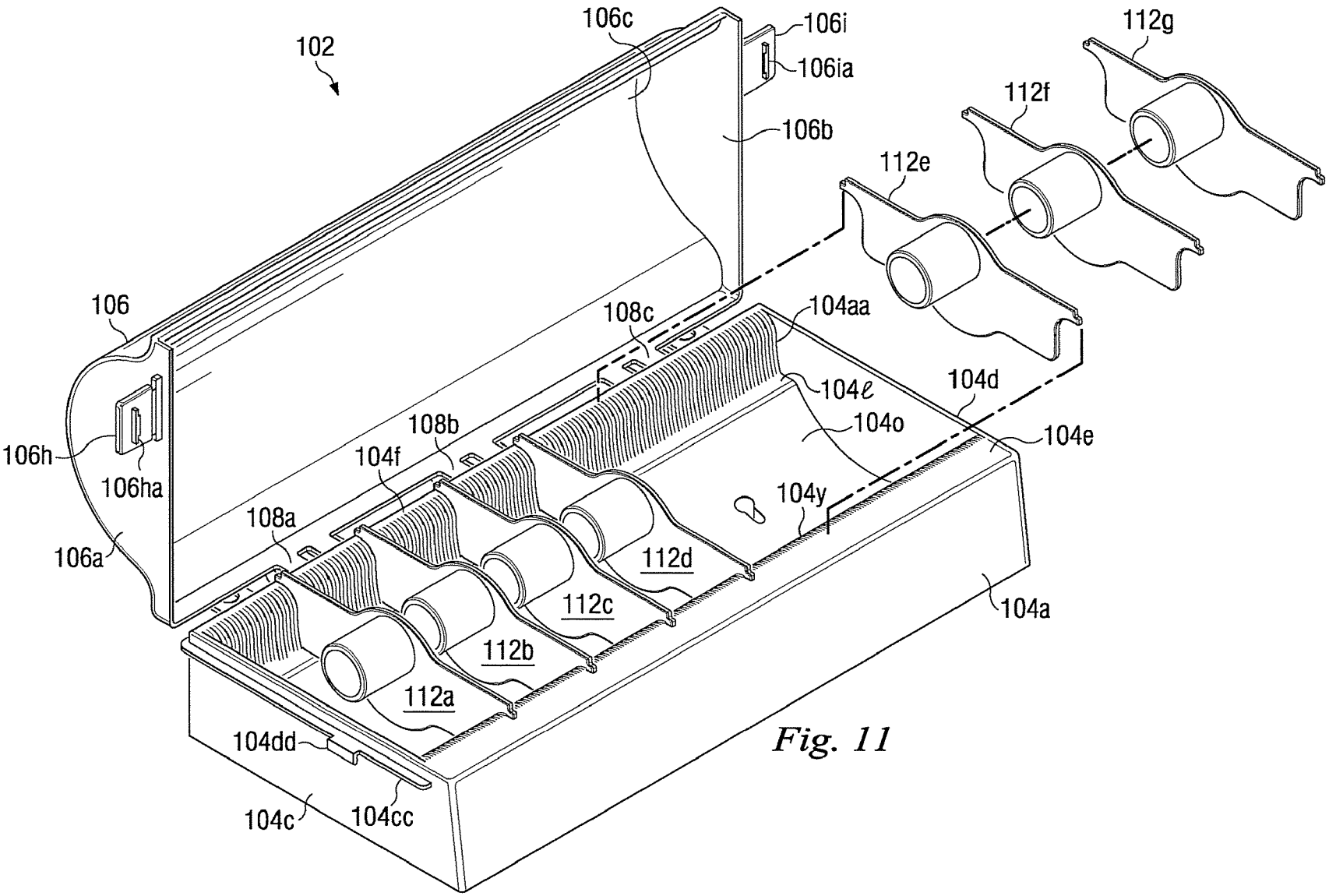
FIG. 11 is a partially-exploded perspective view of the container of FIG. 9, depicting the container in an open position with a plurality of dividers disposed therein.
Figure 12:
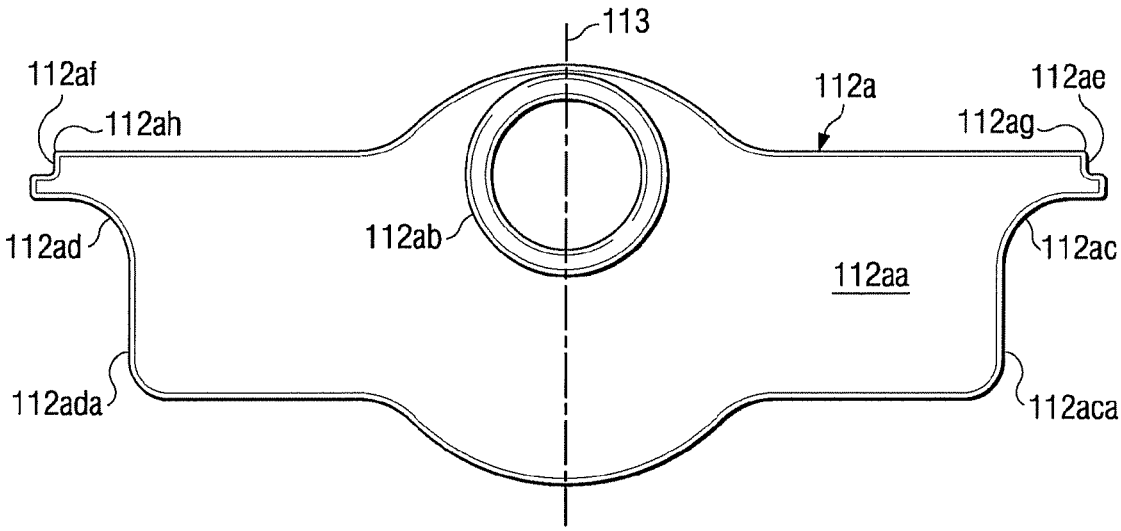
FIG. 12 is an elevational view of one of the dividers of FIG. 11.
Figure 13:
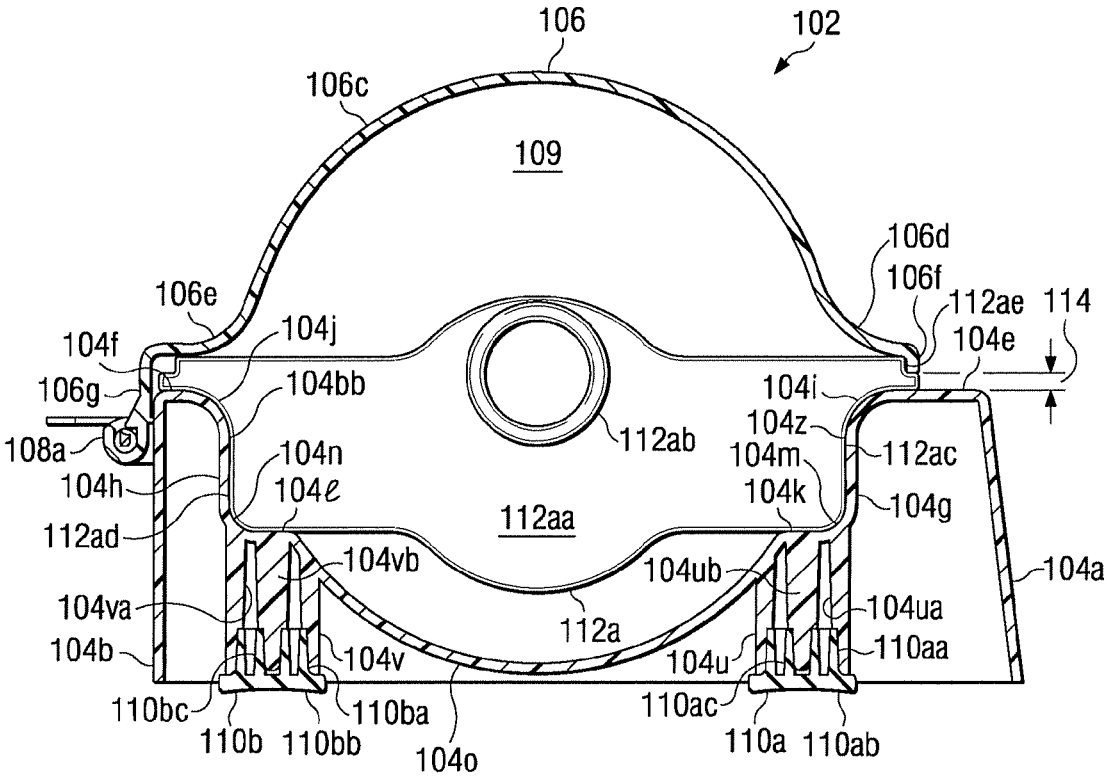
FIG. 13 is a sectional view of the container of FIG. 9 taken along line 13-13.

In an exemplary embodiment, as illustrated in FIGS. 9, 10, 11, 12 and 13, a container is generally referred to by the reference numeral 102 and includes a bottom member or base 104 and a top member or lid 106 hingedly coupled thereto via axially-aligned hinges 108*a*, 108*b* and 108*c*. The lid 106 is pivotable about the hinges 108*a*, 108*b* and 108*c* so as to place the container 102 in either an open position, which is shown in FIG. 11, or a closed position, which is shown in FIGS. 9, 10 and 13.

The base 104 includes walls 104*a* and 104*b*, and parallel-spaced walls 104*c* and 104*d* extending between corresponding ends of the walls 104*a* and 104*b*, respectively, so that the walls 104*a*, 104*b*, 104*c* and 104*d* generally form a four-sided open box. A pair of generally coplanar walls or shelves 104*e* and 104*f* extend from corresponding edges of the walls 104*a* and 104*b*, respectively. A pair of parallel-spaced walls 104*g* and 104*h* extend within the open box generally formed by the walls 104*a*, 104*b*, 104*c* and 104*d*, and are generally parallel to the wall 104*b*. A round 104*i* extends between the shelf 104*e* and the wall 104*g*, and a round 104*j* extends between the shelf 104*f* and the wall 104*h*. Generally coplanar walls or shelves 104*k* and 104*l* extend within the open box generally formed by the walls 104*a*, 104*b*, 104*c* and 104*d*, and are generally parallel to the shelves 104*e* and 104*f*. A fillet 104*m* extends between the wall 104*g* and the shelf 104*k*, and a fillet 104*n* extends between the wall 104*h* and the shelf 104*l*. An arcuate wall 104*o* extends between the shelves 104*k* and 104*l*.

A plurality of parallel-spaced ribs 104*p* extend between the walls 104*a* and 104*b*, and are parallel to the walls 104*c* and 104*d*. Protrusions 104*q* and 104*r* having keyhole slots 104*qa* and 104*ra*, respectively, formed therein extend from the arcuate wall 104*o*. Tabs 104*s* and 104*t* having through-holes 104*sa* and 104*ta*, respectively, extend from wall 104*b* and are generally aligned with the hinges 108*a*, 108*b* and 108*c*. Tubular protrusions 104*u* and 104*v* defining internal passages 104*ua* and 104*va*, respectively, and including protrusions 104*ub* and 104*vb*, respectively, extending within the passages 104*ua* and 104*va*, respectively, extend from the arcuate wall 104*o* and the shelves 104*k* and 104*l*, respectively. The tubular protrusions 104*u* and 104*v* are aligned along one of the ribs 104*p*. The base 104 further includes tubular protrusions 104*w* and 104*x*, which are aligned along another of the ribs 104*p*. The tubular protrusions 104*w* and 104*x* are aligned with, and substantially similar to, the tubular protrusions 104*u* and 104*v*, respectively, and therefore will not be described in further detail.

A plurality of extensions or fins 104*y* extend from the shelf 104*e*, the round 104*i*, the fillet 104*m* and the shelf 104*k*, and adjacent fins 104*y* define a plurality of grooves 104*z*. Similarly, a plurality of extensions or fins 104*aa* extend from the shelf 104*f*, the round 104*j*, the fillet 104*n* and the shelf 104*l*, and adjacent fins 104*aa* define a plurality of grooves 104*bb*. The fins 104*y* and 104*aa* are positioned so as to define pairs of corresponding facing grooves 104*z* and 104*bb*, one pair of which is shown in FIG. 13. A lip 104*cc* extends from, and along, the walls 104*c*, 104*b* and 104*d*, and includes a pair of opposing upside-down-L-shaped protrusions 104*dd*, one of which is shown in FIGS. 9, 10 and 11.

The lid 106 includes parallel-spaced side walls 106*a* and 106*b*, and an arcuate wall 106*c* extending therebetween. A generally fillet-shaped lip 106*d* extends from one side of the arcuate wall 106*c* and between corresponding ends of the side walls 106*a* and 106*b*, and a generally fillet-shaped lip 106*e* extends from the other side of the arcuate wall 106*c* and between the corresponding other ends of the side walls 106*a* and 106*b*. A wall 106*f* extends downward from an edge of the lip 106*d*, and a wall 106*g* extends downward from an edge of the lip 106*e*. Tabs 106*h* and 106*i* are hingedly connected to the walls 106*a* and 106*b*, respectively, and include snap-fit protrusions 106*ha* and 106*ia* extending from the inside surfaces thereof, respectively. A recess 106*j* is formed in the outside surface of the arcuate wall 106*c* and is adapted to, for example, receive a label and/or an embossing to identify the container 102 and/or one or more of the contents therein.

When the container 102 is in the closed position, as illustrated in FIGS. 9, 10 and 13, a generally cylindrically-shaped cavity 109 is generally defined by the respective inside surfaces of the arcuate wall 104*o* of the base 104 and the arcuate wall 106*c* of the lid 106.

Tubular bodies 110*aa* and 110*ba* of suction cups 110*a* and 110*b*, respectively, are received within the passages 104*ua* and 104*va*, respectively, of the tubular protrusions 104*u* and 104*v*, respectively, of the base 104. The suction cups 110*a* and 110*b* further include cupped heads 110*ab* and 110*bb*, respectively, from which the tubular bodies 110*aa* and 110*ba*, respectively, extend, and tubular portions 110*ac* and 110*bc*, respectively, extending within the bodies 110*aa* and 110*ab*, respectively, and within which the protrusions 104*ub* and 104*uv*, respectively, of the base 104 extend. As a result, the suction cups 110*a* and 110*b* are coupled to the tubular protrusions 104*u* and 104*v*, respectively, of the base 104.

Suction cups 110*c* and 110*d* are coupled to the tubular protrusions 104*w* and 104*x*, respectively, of the base 104. The suction cups 110*c* and 110*d* are substantially similar to the suction cups 110*a* and 110*b*, respectively, and therefore neither the suction cups 110*c* and 110*d*, nor the couplings between the tubular protrusions 104*w* and 104*x* and the suction cups 110*c* and 110*d*, respectively, will be described in further detail.

The container 102 further includes dividers 112*a*, 112*b*, 112*c*, 112*d*, 112*e*, 112*f* and 112*g*, which are generally spaced in a parallel relation and supported by the base 104, and which are disposed within the cavity 109 when the container 102 is in the closed position.

The divider 112*a* includes a vertically-extending wall 112*aa* and a generally cylindrical axle or spindle 112*ab* extending from one side of the wall 112*aa*. As shown in FIG. 12, the divider 112*a* is symmetric about a plane 113 that is perpendicular to the wall 112*aa* and passes through the center of the spindle 112*ab*. The wall 112*aa* defines symmetric end portions 112*ac* and 112*ad* in which symmetric notches 112*ae* and 112*af*, respectively, are formed. The end portion 112*ac* defines a contour 112*aca* that generally matches the contour defined by each of the grooves 104*z* of the base 104, that is, the contour defined by the shelf 104*e*, the round 104*i*, the fillet 104*m* and the shelf 104*k* of the base 104. Similarly, the end portion 112*ad* defines a contour 112*ada* that generally matches the contour defined by each of the grooves 104*aa* of the base 104, that is, the contour defined by the shelf 104*f*, the round 104*j*, the fillet 104*n* and the shelf 104*l* of the base 104. The notches 112*ae* and 112*af* define corner portions 112*ag* and 112*ah* respectively.

The dividers 112*b*, 112*c*, 112*d*, 112*e*, 112*f* and 112*g* are substantially similar to the divider 112*a* and therefore the dividers 112*b*, 112*c*, 112*d*, 112*e*, 112*f* and 112*g* will not be described in detail. Reference numerals used to refer to features of the dividers 112*b*, 112*c*, 112*d*, 112*e*, 112*f* and 112*g* will correspond to the reference numerals for the divider 112*a*, except that the prefix for the reference numerals used to describe the divider 112*a*, that is, 112*a*, will be replaced with the numeric prefix of the applicable divider 112*b*, 112*c*, 112*d*, 112*e*, 112*f* or 112*g*, that is, 112*b*, 112*c*, 112*d*, 112*e*, 112*f* or 112*g*.

As noted above, the divider 112*a* is supported by the base 104. More particularly, and as shown in FIG. 13, the end portions 112*ac* and 112*ad* are received within corresponding facing grooves 104*z* and 104*bb*. The contour 112*aca* permits at least a portion and/or edge of the end portion 112*ac* to contact or engage the shelf 104*e* and/or the shelf 104*k*, and the contour 112*ada* permits at least a portion and/or edge of the end portion 112*ad* to contact or engage the shelf 104*f* and/or the shelf 104*l*. As a result, the spindle 112*ab* of the divider 112*a* extends in a direction that is generally parallel to the axis along which the hinges 108*a*, 108*b* and 108*c* are aligned. The arrangement of each of the dividers 112*b*, 112*c*, 112*d*, 112*e*, 112*f* and 112*g* in the container 102 is substantially similar to the arrangement of the divider 112*a* in the container 102. Therefore, the respective arrangements of the dividers 112*b*, 112*c*, 112*d*, 112*e*, 112*f* and 112*g* in the container 102 will not be described in detail.

In an exemplary embodiment, as illustrated in FIG. 13, when the container 102 is in the closed position, a gap 114 is defined between the shelf 104*e* of the base 104 and the distal end of the wall 106*f*, and the wall 106*f* extends into the notches 112*ae*, 112*be*, 112*ce*, 112*de*, 112*ee*, 112*fe* and 112*ge* of the dividers 112*a*, 112*b*, 112*c*, 112*d*, 112*e*, 112*f* and 112*g*, respectively. The corner portions 112*ag*, 112*bg*, 112*cg*, 112*dg*, 112*eg*, 112*fg* and 112*gg* of the dividers 112*a*, 112*b*, 112*c*, 112*d*, 112*e*, 112*f* and 112*g*, respectively, and/or one or more edges or portions of the respective dividers proximate or at the respective corner portions, contact the inside surface of the lid 106 at or near the interface between the wall 106*f* and the lip 106*d*. In an exemplary embodiment, the distal end of the wall 106*f* extends into the notches 112*ae*, 112*be*, 112*ce*, 112*de*, 112*ee*, 112*fe* and 112*ge*, and rests against portions of the end portions 112*ac*, 112*bc*, 112*cc*, 112*dc*, 112*ec*, 112*fc* and 112*gc* defined by the notches 112*ae*, 112*be*, 112*ce*, 112*de*, 112*ee*, 112*fe* and 112*ge*, respectively, of the dividers 112*a*, 112*b*, 112*c*, 112*d*, 112*e*, 112*f* and 112*g*, respectively.

Figure 14:
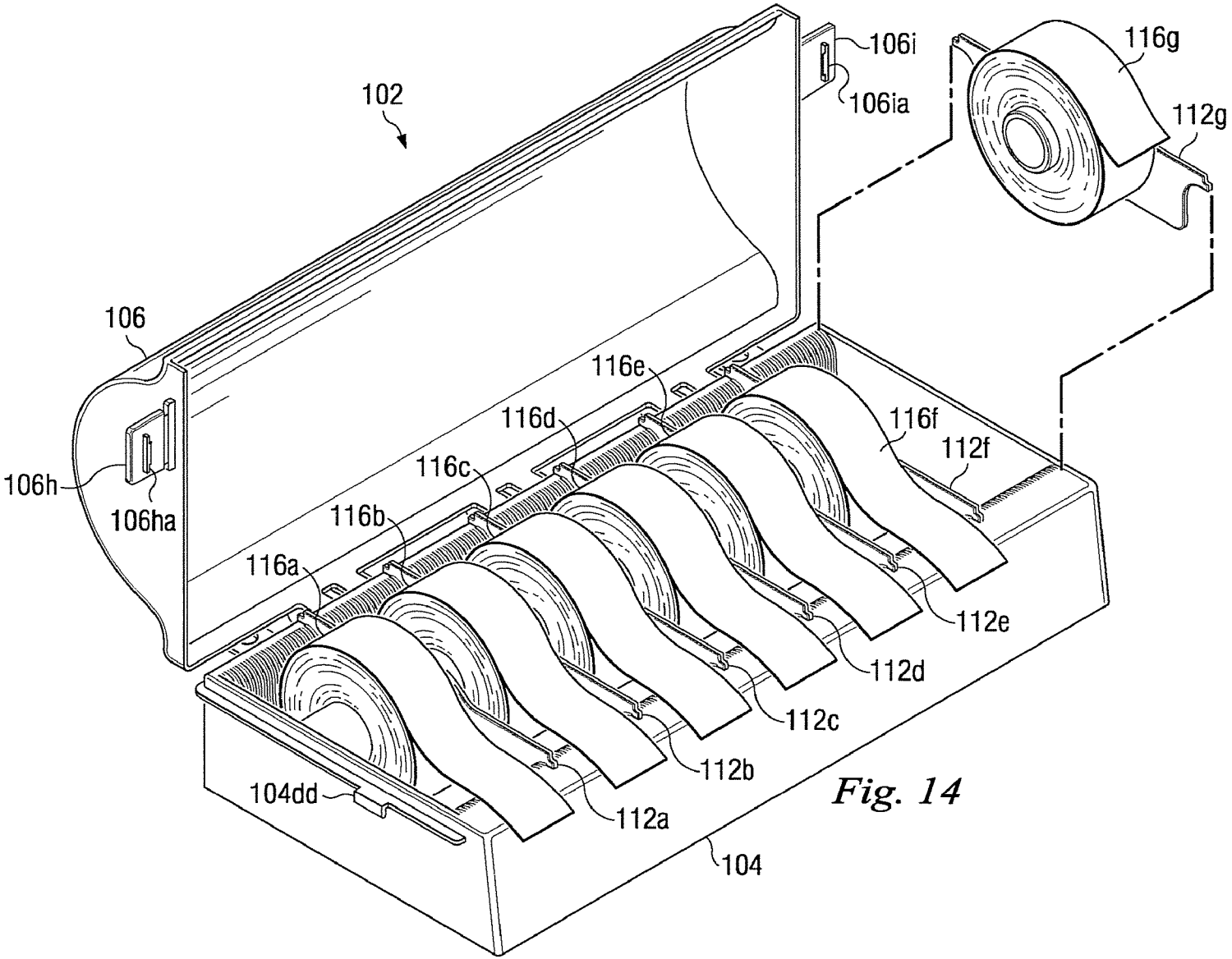
FIG. 14 is a view similar to that of FIG. 11, but depicting rolls engaged with respective ones of the dividers.
Figure 15:
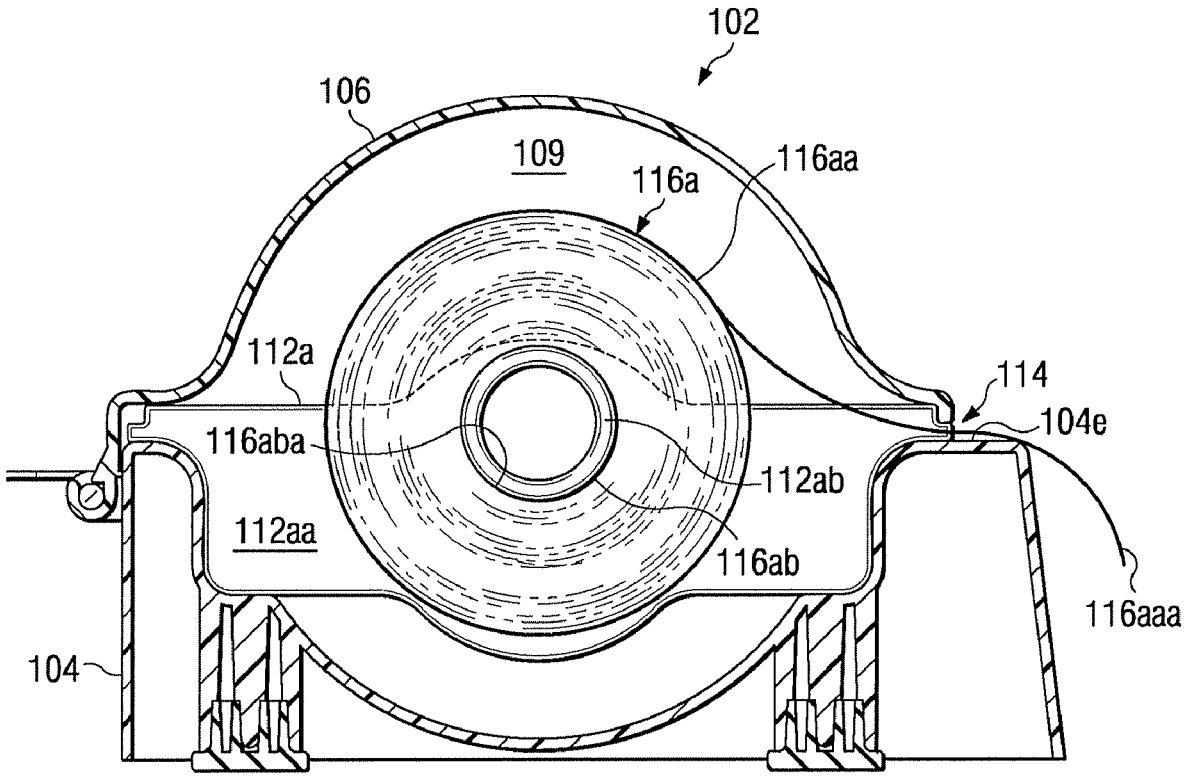
FIG. 15 is a view similar to that of FIG. 13, but depicting a roll disposed in the container.

In an exemplary embodiment, as illustrated in FIGS. 14 and 15, rolls 116*a*, 116*b*, 116*c*, 116*d*, 116*e*, 116*f* and 116*g* are disposed in the container 102 and removably engaged with, and supported by, the dividers 112*a*, 112*b*, 112*c*, 112*d*, 112*e*, 112*f* and 112*g*, respectively.

In an exemplary embodiment, as illustrated in FIG. 15, the roll 116*a* includes material 116*aa*, which is wound around a core 116*ab* defining an internal passage 116*aba*. The spindle 112*ab* of the divider 112*a* extends within the internal passage 116*aba* of the core 116*ab* of the roll 116*a*, thereby contacting the core 116*ab* and supporting the roll 116*a* within the container 102. As a result of its support by the divider 112*a*, the roll 116*a* is generally suspended within the generally cylindrically-shaped cavity 109. An end 116*aaa* of the material 116*aa* of the roll 116*a* extends from the remainder of the material 116*aa* and over the shelf 104*e* of the base 104. When the container 102 is in the closed position, as shown in FIG. 15, the end 116*aaa* of the material 116*aa* extends through the gap 114 defined between the end of the wall 106*f* of the lid 106 and the shelf 104*e* of the base 104. In an exemplary embodiment, the roll 116*a* abuts the wall 112*aa* of the divider 112*a*.

The rolls 116*b*, 116*c*, 116*d*, 116*e*, 116*f* and 116*g* are substantially similar to the roll 116*a* and therefore the rolls 116*b*, 116*c*, 116*d*, 116*e*, 116*f* and 116*g* will not be described in detail. Reference numerals used to refer to features of the rolls 116*b*, 116*c*, 116*d*, 116*e*, 116*f* and 116*g* will correspond to the reference numerals for the roll 116*a*, except that the prefix for the reference numerals used to describe the roll 116*a*, that is, 116*a*, will be replaced with the numeric prefix of the applicable roll 116*b*, 116*c*, 116*d*, 116*e*, 116*f* or 116*g*, that is, 116*b*, 116*c*, 116*d*, 116*e*, 116*f* or 116*g*.

The rolls 116*b*, 116*c*, 116*d*, 116*e*, 116*f* and 116*g* are disposed within the container 102 and supported by the dividers 112*b*, 112*c*, 112*d*, 112*e*, 112*f* and 112*g*, respectively, in a manner substantially similar to the manner in which the roll 116*a* is disposed within the container 102 and supported by the divider 112*a*.

In an exemplary embodiment, the container 102 may be installed by hanging the container 102 against a wall by inserting fasteners through the holes 104*sa* and 104*ta* of the tabs 104*s* and 104*t*, respectively; in an exemplary embodiment, the container 102 may be hung and pressed against the wall so that the suction cups 110*a*, 110*b*, 110*c* and 110*d* operate to resist relative movement between the container 102 and the wall. In an exemplary embodiment, the container 102 may be installed by placing the container 102 on a flat, horizontal surface; in an exemplary embodiment, the container 102 may be pressed against the horizontal surface so that the suction cups 110*a*, 110*b*, 110*c* and 110*d* operate to resist relative movement between the container 102 and the horizontal surface. In an exemplary embodiment, the container 102 may be installed by engaging the keyhole slots 104*qa* and 104*ra* with fasteners or protrusions extending from a wall or surface; in an exemplary embodiment, the container may be pressed against the wall or surface so that the suction cups 110*a*, 110*b*, 110*c* and 110*d* operate to resist relative movement between the container 102 and the wall or surface. In an exemplary embodiment, the container 102 may be hung from peg board using the tabs 104*s* and 104*t*, and/or the keyhole slots 104*qa* and 104*ra*. In an exemplary embodiment, the container 102 may be installed on a shelf.

In an exemplary embodiment, after the rolls 116*a*, 116*b*, 116*c*, 116*d*, 116*e*, 116*f* and 116*g* are disposed within the container 102 as described above, the container 102 is placed in the closed position by closing the lid 106 and engaging the snap-fit protrusions 106*ha* and 106*ia* of the lid 106 with the respective L-shaped protrusions 104*dd* of the base 104, thereby forming snap-fit engagements to secure the lid 106 in place. As a result, the material ends 116*aaa*, 116*baa*, 116*caa*, 116*daa*, 116*eaa*, 116*faa* and 116*gaa* extend through the gap 114 to permit the dispensing of the material 116*aa*, 116*ba*, 116*ca*, 116*da*, 116*ea*, 116*fa* and 116*ga*, respectively.

In operation, in an exemplary embodiment and as illustrated in FIG. 15, the material 116*aa* is dispensed from the roll 116*a* by pulling on the end 116*aaa* of the material 116*aa*. In response, the roll 116*a* rotates in place about the spindle 112*ab*. Since the roll 116*a* extends within the cavity 109 and is suspended by the divider 112*a*, the other parts of the container 102 do not interfere with the rotation of the roll 116*a* and thus do not interfere with the dispensing of the material 116*aa*.

During operation, in an exemplary embodiment, the lid 106 and the base 104, and the secure engagement therebetween, protect the roll 116*a* from damage such as, for example, physical damage, and/or exposure to contaminants and/or messes associated with kitchens and/or food-preparation activities.

During operation, in an exemplary embodiment, the spindle 112*ab* helps to hold the roll 116*a* in place within the container 102 such that movement of the roll 116*a* is substantially limited to the rotation of the roll 116*a* about the spindle 112*ab*, which rotation occurs as the material 116*aa* is dispensed from the roll 116*a*, as noted above. Since the spindle 112*ab* generally holds the roll 116*a* in place, the potential for jamming, and/or interference with adjacent roll 116*b*, is reduced.

During operation, in an exemplary embodiment, any movement of the material 116*aa*, including the end 116*aaa*, in a direction generally transverse to the dispensing direction and along the shelf 104*e* of the base 104, is limited to the portion of the gap 114 extending between the wall 106*h* of the lid 106 and the wall 112*aa* of the divider 112*a*. That is, the material 116*aa*, as it is being dispensed from the roll 116*a*, is prevented from sliding along the shelf 104*e* by the wall 106*h* of the lid 106 and the wall 112*aa* of the divider 112*a*. Moreover, the above-described contact between the inside surface of the lid 106, and the corner portion 112*ag* of the divider 112*a* and/or a portion of the divider 112*a* near the corner portion 112*ag*, prevents, or at least resists, the material 116*aa* from sliding over the divider 112*a* and into the portion of the gap 114 that extends between the divider 112*a* and the divider 112*b*. As a result, the potential for any interference between, and/or jamming of, the rolls 116*a* and 116*b* is further reduced, thereby further facilitating the dispensing of the material 116*aa* from the roll 116*a*.

An additional effect of the spindle 112*ab* is to reduce the movement of the roll 116*a* when the container 102 is in a position that would dispense material in a direction other than generally parallel with respect to the ground. For example, if the container 102 is mounted on a wall such that the material 116*aa* is dispensed in a direction generally perpendicular with respect to the ground, the spindle 112*ab* helps to hold the roll 116*a* in place within the container 102, even when the container 102 is in the open position. As another example, if the container 102 falls from a countertop, the spindle 112*ab* helps to hold the roll 116*a* in place within the container 102, regardless of whether the container 102 is in the open or closed position.

Because the divider 112*a* is removably engaged within corresponding facing grooves 104*z* and 104*bb*, the divider 112*a* can be removed from the cavity 109 by simply pulling it out of the base 104. Thus, when the roll 116*a* needs to be replaced or refilled with additional material, the divider 112*a* and the roll 116*a* can be removed together and the roll 116*a* can then be replaced with another roll, without the need to remove any other of the rolls 116*b*, 116*c*, 116*d*, 116*e*, 116*f* and 116*g* held in the container 102.

The roll 116*b* is held in place by the spindle 112*bb* of the divider 112*b*, and the walls 112*aa* and 112*ba* of the dividers 112*a* and 112*b*, respectively, prevent any appreciable movement and/or migration of the material 116*ba* of the roll 116*b*, including the end 116*baa* of the material, in a manner substantially similar to the above-described manner in which the wall 106*a* and the wall 112*aa* prevent and/or limit any appreciable movement and/or migration of the material 116*aa* of the roll 116*a*. Similarly, the rolls 116*c*, 116*d*, 116*e*, 116*f* and 116*g* are held in place by the spindles 112*cb*, 112*db*, 112*eb*, 112*fb* and 112*gb*, respectively, and appreciable movement of the respective materials of these rolls are prevented by the walls 112*ba* and 112*ca*, the walls 112*ca* and 112*da*, the walls 112*da* and 112*ea*, the walls 112*ea* and 112*fa*, and the walls 112*fa* and 112*ga*, respectively, in a manner substantially similar to the manner in which the walls 112*aa* and 112*ba* prevent and/or limit any appreciable movement and/or migration of the material 116*ba* of the roll 116*a*.

The operation of the container 102 with respect to each of the rolls 116*b*, 116*c*, 116*d*, 116*e*, 116*f* and 116*g* is substantially similar to the above-described operation of the container 102 with respect to the roll 116*a*, and therefore will not be described in detail.

In several exemplary embodiments, the container 102 may be configured to hold a wide variety of rolls of material having a wide variety of sizes by, for example, adding additional dividers to hold smaller-sized rolls of materials, and/or removing dividers in order to hold larger-sized rolls of materials.

In an exemplary embodiment, each of the rolls 116*a*, 116*b*, 116*c*, 116*d*, 116*e*, 116*f* and 116*g* is 2 inches wide.

Figure 16:
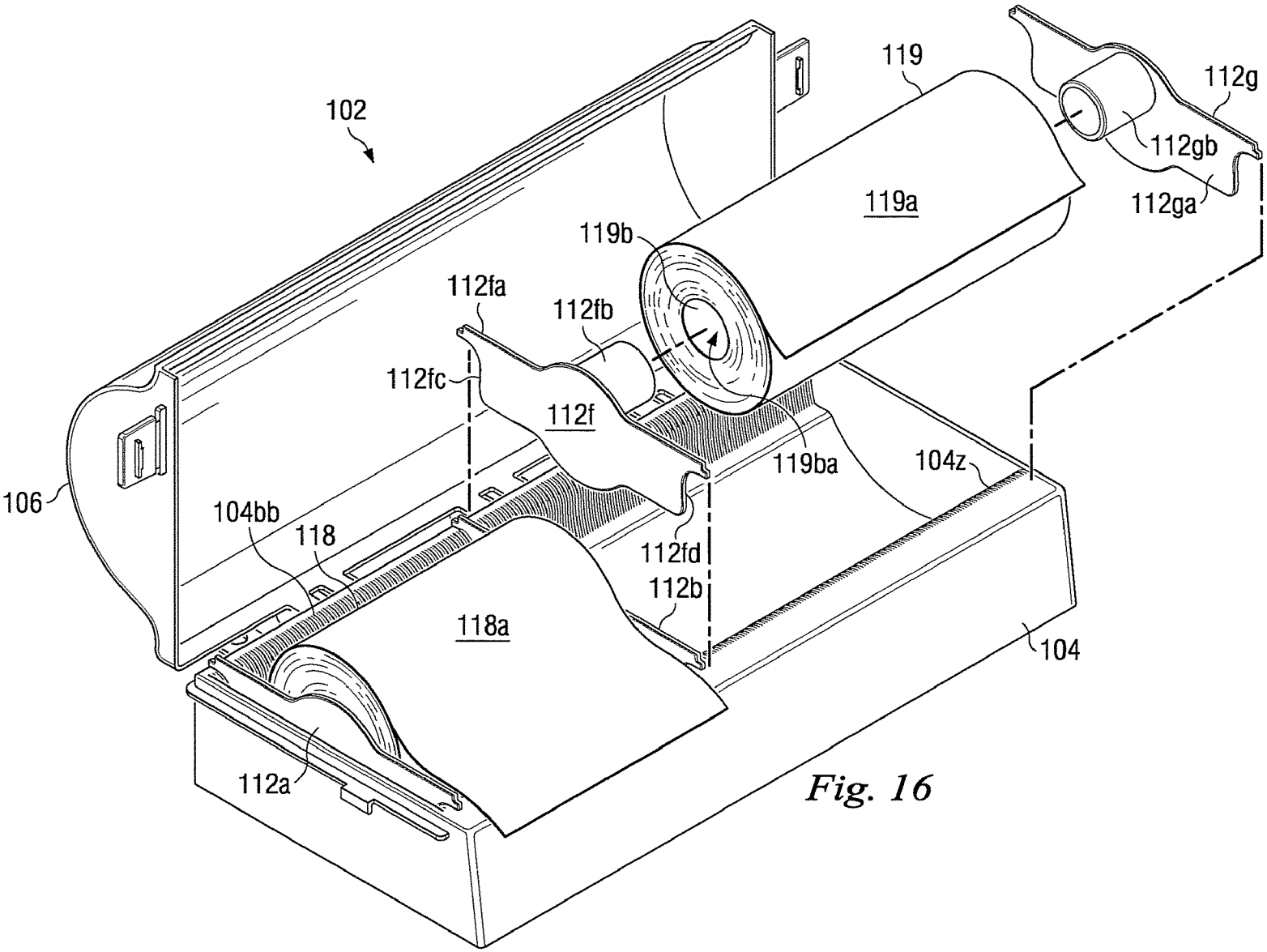
FIG. 16 is a view similar to that of FIG. 14, but depicting differently-sized rolls engaged with respective pairs of the dividers.

In an exemplary embodiment, as illustrated in FIG. 16, the container 102 only includes the dividers 112*a*, 112*b*, 112*f* and 112*g*. Rolls 118 and 119 including material 118*a* and 119*a*, respectively, are disposed within the container 102. The respective widths of the rolls 118 and 119 are larger than the respective widths of the rolls 116*a*, 116*b*, 116*c*, 116*d*, 116*e*, 116*f* and 116*g*. Moreover, the width of the roll 119 is larger than the width of the roll 118.

The roll 119 includes a core 119*b*, which defines an internal passage 119*ba*. The dividers 112*f* and 112*g* support the roll 119, with the spindle 112*fb* of the divider 112*f* extending into the internal passage 119*ba* at one end of the core 119*b*, and the spindle 112*gb* of the divider 112*g* extending into the internal passage 119*ba* at the other end of the core 119*b*. Since the divider 112*f* is symmetric about a plane in the same manner as the divider 112*a* is symmetric about the plane 113, the divider 112*f* is able to be rotated 180 degrees so that the end portions 112*fc* and 112*fd* are received within corresponding facing grooves 104*bb* and 104*z*, respectively, as shown in FIG. 16. Similarly, the dividers 112*a* and 112*b* support the roll 118, with the spindle 112*ab* of the divider 112*a* extending into an internal passage defined by a core (not shown) of the roll 118 at one end thereof, and the spindle 112*bb* of the divider 112*b* extending into the internal passage at the other end of the core of the roll 118. Since the divider 112*a* is symmetric about the plane 113, the divider 112*a* is able to be rotated 180 degrees so that the end portions 112*ac* and 112*ad* are received within corresponding facing grooves 104*bb* and 104*z*, respectively, as shown in FIG. 16. The dispensing of the material 118*a* and 119*a* from the rolls 118 and 119, respectively, is substantially similar to the dispensing of any of the material 116*aa*, 116*ba*, 116*ca*, 116*da*, 116*ea*, 116*fa* and 116*ga* from the container 102, as described above, and therefore will not be described in further detail.

Figure 17:
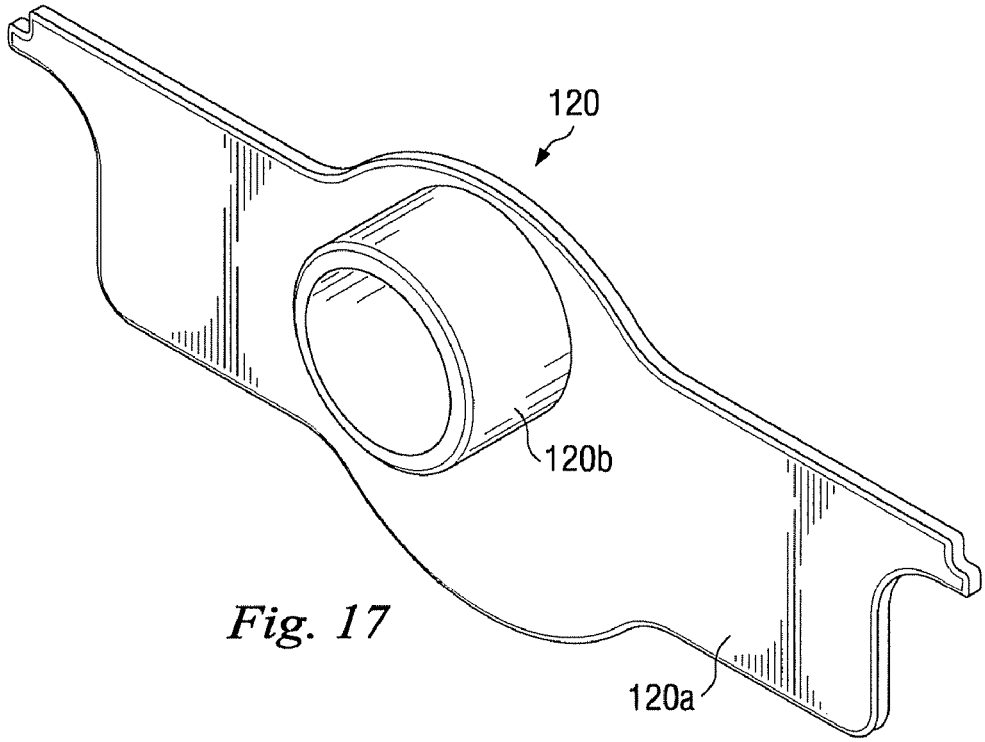
FIG. 17 is a perspective view of a divider according to another exemplary embodiment.

In an exemplary embodiment, as illustrated in FIG. 17, a divider is generally referred to by the reference numeral 120 and includes a wall 120*a* and an axle or spindle 120*b* extending from one side of the wall 120*a*. The divider 120 is substantially similar to the divider 116*a*, except that the length of extension of the spindle 120*b* from the wall 120*a* of the divider 120 is less than the length of extension of the spindle 112*ab* from the wall 112*aa* of the divider 112*a*; therefore, the remainder of the divider 120 will not be described in detail.

In several exemplary embodiments, the dimensions of the base 104 and the lid 106 may be increased or decreased, and one or more of the dimensions of the dividers 112*a*, 112*b*, 112*c*, 112*d*, 112*e*, 112*f*, 112*g* and 120 may also be correspondingly increased or decreased.

In several exemplary embodiments, the containers 10 and/or 102 can be used in a variety of industries such as, for example, the food service industry. In an exemplary embodiment, the container 10 or 102 has a plurality of dividers sufficient to hold seven rolls of labels, i.e., one roll of labels for each day of the week. A label corresponding to the day on which food is prepared or is stored is pulled from the container 10 and/or 102 and applied to the surface of a container or wrapping holding the food.

In an exemplary embodiment, the top of the container 10 could have a raised or indented portion for receiving a company name or logo, either by embossing or by receiving a label.

In several exemplary embodiments, the containers 10 and/or 102, and all of the parts thereof, can be made from a variety of materials, including but not limited to plastic, cardboard and metal. Suitable plastics include but are not limited to polyvinyl chloride, polyethylene, polyethylene terephthalate, polypropylene and cellulose propionate. In several exemplary embodiments, the containers 10 and/or 102 can be made from a plastic using methods such as, for example, thermal molding and injection molding.

In several exemplary embodiments, in addition to, or instead of dispensing labels, any type of material can be dispensed from a roll using one or more of the above-described exemplary embodiments of containers, including the containers 10 and/or 102.

A container has been described that includes a cavity defined by a top member and a bottom member, which top member and bottom member are attached for pivotal movement about an axis; wherein the bottom member comprises first and second walls extending generally parallel to the axis; and a shelf extending from the second wall in a plane generally perpendicular to the second wall and generally parallel to the axis; wherein the top member comprises a lip extending over a portion of the shelf; and at least one divider disposed within the cavity and extending between the first and second walls generally perpendicular to the axis, and comprising a projection extending from the divider over at least a portion of the shelf and comprising a top edge in contact with at least a portion of the lip. In an exemplary embodiment, the bottom member further comprises a first plurality of grooves defined on the first wall; and a second plurality of grooves defined on the second wall; wherein the at least one divider is engaged within facing ones of the first and second pluralities of grooves. In an exemplary embodiment, the bottom member further comprises a first plurality of extensions defined on the first wall; a second plurality of extensions defined on the second wall; wherein the at least one divider is engaged between adjacent ones of the first plurality of extensions and adjacent ones of the second plurality of extensions. In an exemplary embodiment, the container comprises first and second tabs pivotally connected to the top member about parallel axes that are perpendicular to the axis about which the top member and the bottom member are connected; and first and second locks connected to the bottom member at a position so as to engage the first and second tabs, respectively. In an exemplary embodiment, the container comprises a plurality of dividers disposed within the cavity; and a plurality of cores disposed within the cavity between adjacent ones of the plurality of dividers. In an exemplary embodiment, the bottom member further comprises at least one of a plurality of frictional areas and a plurality of mounting means located on the bottom of the bottom member. In an exemplary embodiment, the container comprises a plurality of mounting means spaced longitudinally along the axis of the container. In an exemplary embodiment, the at least one divider further comprises at least one spindle extending from the divider parallel to the axis. In an exemplary embodiment, the container comprises at least one core disposed on the spindle of the at least one divider. In an exemplary embodiment, the at least one divider further comprises at least one spindle positioned on each of opposing sides of the divider, and extending from the divider in a direction generally parallel to the axis of the container. In an exemplary embodiment, the cavity has a generally cylindrical shape. In an exemplary embodiment, the divider is symmetric about at least one plane, the at least one plane being generally parallel to the axis and generally perpendicular to both the divider and the shelf.

A container has been described that includes a cavity defined by a top member and a bottom member, which top member and bottom member are attached for pivotal movement about an axis; wherein the bottom member comprises first and second walls extending generally parallel to the axis; and a shelf extending from the second wall in a plane generally perpendicular to the second wall and generally parallel to the axis; wherein the top member comprises a lip extending over a portion of the shelf, and terminating at an edge that is spaced apart from the shelf so as to define a gap between the shelf and the lip; and at least one divider disposed within the cavity and extending between the first and second walls generally perpendicular to the axis, and comprising a projection extending from the divider over at least a portion of the shelf and comprising a top edge in contact with at least a portion of the lip proximal to the terminal edge of the lip; a bottom edge in contact with the shelf; and a facing edge that spans the gap between the shelf and the lip. In an exemplary embodiment, the bottom member further comprises a first plurality of grooves defined on the first wall; and a second plurality of grooves defined on the second wall; wherein the at least one divider is engaged within facing ones of the first and second pluralities of grooves. In an exemplary embodiment, the bottom member further comprises a first plurality of extensions defined on the first wall; a second plurality of extensions defined on the second wall; wherein the at least one divider is engaged between adjacent ones of the first plurality of extensions and adjacent ones of the second plurality of extensions. In an exemplary embodiment, the container comprises first and second tabs pivotally connected to the top member about parallel axes that are perpendicular to the axis about which the top member and the bottom member are connected; and first and second locks connected to the bottom member at a position so as to engage the first and second tabs, respectively. In an exemplary embodiment, the container comprises a plurality of dividers disposed within the cavity; and a plurality of cores disposed within the cavity between adjacent ones of the plurality of dividers. In an exemplary embodiment, the bottom member further comprises at least one of a plurality of frictional areas and a plurality of mounting means located on the bottom of the bottom member. In an exemplary embodiment, the container comprises a plurality of mounting means spaced longitudinally along the axis of the container. In an exemplary embodiment, the at least one divider further comprises at least one spindle extending from the divider parallel to the axis. In an exemplary embodiment, the container comprises at least one core disposed on the spindle of the at least one divider. In an exemplary embodiment, the at least one divider further comprises at least one spindle positioned on each of opposing sides of the divider, and extending from the divider in a direction generally parallel to the axis of the container. In an exemplary embodiment, the cavity has a generally cylindrical shape.

A kit has been described that includes a container comprising a cavity defined by a top member and a bottom member, which top member and bottom member are attached for pivotal movement about an axis; wherein the bottom member comprises first and second walls extending generally parallel to the axis; and a shelf extending from the second wall in a plane generally perpendicular to the second wall and generally parallel to the axis; wherein the top member comprises a lip extending over a portion of the shelf; and at least one divider comprising at least one spindle extending from the divider; and a projection extending from the divider, wherein the projection comprises a top edge; and a bottom edge; wherein the at least one divider is adapted for disposal within the cavity such that the at least one divider extends between the first and second walls generally perpendicular to the axis, and wherein the projection is adapted to extend from the divider over at least a portion of the shelf, and the adaptation is such that the top edge is in contact with at least a portion of the lip, and the bottom edge is in contact with the shelf. In an exemplary embodiment, the kit comprises first and second tabs pivotally connected to the top member about parallel axes that are perpendicular to the axis about which the top member and the bottom member are connected; and first and second locks connected to the bottom member at a position so as to engage the first and second tabs, respectively. In an exemplary embodiment, the kit comprises at least one divider having at least one spindle positioned on each of opposing sides thereof the divider.

A method has been described that includes providing a container comprising a base and a lid coupled thereto; removably engaging a first roll of material with a first divider; removably engaging the first divider with the base; and dispensing material from the first roll of material after removably engaging the first roll of material with the first divider and removably engaging the first divider with the base. In an exemplary embodiment, the method comprises securing the lid to the base to define a cavity; suspending the first roll of material within the cavity; and rotating the first roll of material in place within the cavity in response to dispensing material from the first roll of material, while maintaining the suspension of the first roll of material within the cavity. In an exemplary embodiment, the method comprises resisting any sliding of material from the first roll of material over the first divider during dispensing material from the first roll of material. In an exemplary embodiment, the method comprises securing the lid to the base to define a gap therebetween; wherein material is dispensed from the first roll of material through the gap. In an exemplary embodiment, the method comprises removably engaging a second divider with the base; wherein the first and second dividers comprise respective walls; and wherein the respective walls of the first and second dividers are spaced in a parallel relation after removably engaging the first divider with the base and removably engaging the second divider with the base. In an exemplary embodiment, material is dispensed from the first roll of material in a first direction; and wherein the method further comprises limiting any movement of material from the first roll of material in a second direction to a portion of the gap extending between the first and second dividers during dispensing material from the first roll of material, wherein the second direction is generally transverse to the first direction. In an exemplary embodiment, the method comprises resisting any sliding of material from the first roll of material over the first divider during dispensing material from the first roll of material; and resisting any sliding of material from the first roll of material over the second divider during dispensing material from the first roll of material. In an exemplary embodiment, the method comprises removably engaging a second roll of material with the second divider; and dispensing material from the second roll of material through the gap after removably engaging the second roll of material with the second divider and removably engaging the second divider with the base. In an exemplary embodiment, the method comprises removably engaging the first roll of material with the second divider; wherein the first roll of material is suspended within the cavity by the first and second dividers. In an exemplary embodiment, the first divider is symmetric about at least one plane.

A container for dispensing material from a roll comprising a core defining an internal passage has been described that includes a base; a lid coupled to the base; a first divider removably engaged with the base, the first divider comprising a wall; and at least one spindle extending from the wall and adapted to extend in the internal passage defined by the core of the roll. In an exemplary embodiment, the base comprises a first plurality of grooves; and a second plurality of grooves facing the first plurality of grooves; wherein the at least one divider is removably engaged within facing ones of the first and second pluralities of grooves. In an exemplary embodiment, the container comprises an open position; and a closed position in which a cavity is defined by the bottom member and the top member; a gap is defined between the top member and the bottom member, wherein the material is adapted to be dispensed from the roll through the gap; and the divider contacts the top member, wherein the contact between the divider and the lid is adapted to resist any sliding of the material over the divider. In an exemplary embodiment, the spindle is adapted to suspend the roll of material within the cavity defined by the bottom member and the top member so that the roll of material is permitted to rotate in place when the material is dispensed from the roll of material. In an exemplary embodiment, the material is adapted to be dispensed through the gap in a first direction; and wherein the at least one divider at least partially defines a portion of the gap to which movement of the material in a second direction generally transverse to the first direction is adapted to be limited when the material is being dispensed from the roll of material. In an exemplary embodiment, the at least one divider is symmetric about at least one plane.

A system has been described that includes means for providing a container comprising a base and a lid coupled thereto; means for removably engaging a first roll of material with a first divider; means for removably engaging the first divider with the base; and means for dispensing material from the first roll of material after removably engaging the first roll of material with the first divider and removably engaging the first divider with the base. In an exemplary embodiment, the system comprises means for securing the lid to the base to define a cavity; means for suspending the first roll of material within the cavity; and means for rotating the first roll of material in place within the cavity in response to dispensing material from the first roll of material, while maintaining the suspension of the first roll of material within the cavity. In an exemplary embodiment, the system comprises means for resisting any sliding of material from the first roll of material over the first divider during dispensing material from the first roll of material. In an exemplary embodiment, the system comprises means for securing the lid to the base to define a gap therebetween; wherein material is dispensed from the first roll of material through the gap. In an exemplary embodiment, the system comprises means for removably engaging a second divider with the base; wherein the first and second dividers comprise respective walls; and wherein the respective walls of the first and second dividers are spaced in a parallel relation after removably engaging the first divider with the base and removably engaging the second divider with the base. In an exemplary embodiment, the system comprises material is dispensed from the first roll of material in a first direction; and wherein the system further comprises means for limiting any movement of material from the first roll of material in a second direction to a portion of the gap extending between the first and second dividers during dispensing material from the first roll of material, wherein the second direction is generally transverse to the first direction. In an exemplary embodiment, the system comprises means for resisting any sliding of material from the first roll of material over the first divider during dispensing material from the first roll of material; and means for resisting any sliding of material from the first roll of material over the second divider during dispensing material from the first roll of material. In an exemplary embodiment, the system comprises means for removably engaging a second roll of material with the second divider; and means for dispensing material from the second roll of material through the gap after removably engaging the second roll of material with the second divider and removably engaging the second divider with the base. In an exemplary embodiment, the system comprises means for removably engaging the first roll of material with the second divider; wherein the first roll of material is suspended within the cavity by the first and second dividers. In an exemplary embodiment, the first divider is symmetric about at least one plane.

A container for dispensing material from a roll comprising a core defining an internal passage has been described that includes a bottom member and a top member attached to the bottom member for pivotal movement about an axis, the bottom and top members defining a cavity having a generally cylindrical shape, the bottom member comprising first and second walls extending generally parallel to the axis, a shelf extending from the second wall in a plane generally perpendicular to the second wall and generally parallel to the axis, a first plurality of grooves defined on the first wall, and a second plurality of grooves defined on the second wall, the top member comprising a lip extending over a portion of the shelf; at least one divider disposed within the cavity and engaged within facing ones of the first and second pluralities of grooves, the at least one divider extending between the first and second walls generally perpendicular to the axis, the at least one divider comprising a projection extending from the divider over at least a portion of the shelf and comprising a top edge in contact with at least a portion of the lip, and a bottom edge in contact with the shelf; and at least one spindle extending from the divider generally parallel to the axis, the spindle being adapted to extend within the internal passage defined by the core of the roll; wherein the spindle suspends the roll within the cavity defined by the bottom member and the top member so that the roll is permitted to rotate in place when the material is dispensed from the roll.

It is understood that variations may be made in the foregoing without departing from the scope of the disclosure. Furthermore, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A container comprising:

a cavity defined by a top member and a bottom member, which top member and bottom member are attached for pivotal movement about an axis;

wherein the bottom member comprises:

first and second walls extending generally parallel to the axis; and a shelf extending from the second wall in a plane generally perpendicular to the second wall and generally parallel to the axis;

wherein the top member comprises:

a lip extending over a portion of the shelf;

and at least one divider disposed within the cavity and extending between the first and second walls generally perpendicular to the axis, and comprising:

a projection extending from the divider over at least a portion of the shelf and comprising a top edge in contact with at least a portion of the lip.

2. The container of claim 1 wherein the bottom member further comprises:

a first plurality of grooves defined on the first wall; and a second plurality of grooves defined on the second wall;

wherein the at least one divider is engaged within facing ones of the first and second pluralities of grooves.

3. The container of claim 1 wherein the bottom member further comprises:

a first plurality of extensions defined on the first wall;

a second plurality of extensions defined on the second wall;

wherein the at least one divider is engaged between adjacent ones of the first plurality of extensions and adjacent ones of the second plurality of extensions.

4. The container of claim 1 further comprising:

first and second tabs pivotally connected to the top member about parallel axes that are perpendicular to the axis about which the top member and the bottom member are connected;

and first and second locks connected to the bottom member at a position so as to engage the first and second tabs, respectively.

5. The container of claim 1 further comprising:

a plurality of dividers disposed within the cavity; and a plurality of cores disposed within the cavity between adjacent ones of the plurality of dividers.

6. The container of claim 1 wherein the bottom member further comprises at least one of a plurality of frictional areas and a plurality of mounting means located on the bottom of the bottom member.

7. The container of claim 1 further comprising a plurality of mounting means spaced longitudinally along the axis of the container.

8. The container of claim 1 wherein the at least one divider further comprises:

at least one spindle extending from the divider parallel to the axis.

9. The container of claim 8 further comprising:

at least one core disposed on the spindle of the at least one divider.

10. The container of claim 1 wherein the at least one divider further comprises:

at least one spindle positioned on each of opposing sides of the divider, and extending from the divider in a direction generally parallel to the axis of the container.

11. The container of claim 1 wherein the cavity has a generally cylindrical shape.

12. The container of claim 1 wherein the divider is symmetric about at least one plane, the at least one plane being generally parallel to the axis and generally perpendicular to both the divider and the shelf.

13. A kit comprising:

a container comprising a cavity defined by a top member and a bottom member, which top member and bottom member are attached for pivotal movement about an axis;

wherein the bottom member comprises:

first and second walls extending generally parallel to the axis; and a shelf extending from the second wall in a plane generally perpendicular to the second wall and generally parallel to the axis;

wherein the top member comprises:

a lip extending over a portion of the shelf;

and at least one divider comprising:

at least one spindle extending from the divider; and a projection extending from the divider, wherein the projection comprises:

a top edge; and a bottom edge;

wherein the at least one divider is adapted for disposal within the cavity such that the at least one divider extends between the first and second walls generally perpendicular to the axis, and wherein the projection is adapted to extend from the divider over at least a portion of the shelf, and the adaptation is such that the top edge is in contact with at least a portion of the lip, and the bottom edge is in contact with the shelf.

14. The kit of claim 13 further comprising:

first and second tabs pivotally connected to the top member about parallel axes that are perpendicular to the axis about which the top member and the bottom member are connected;

and first and second locks connected to the bottom member at a position so as to engage the first and second tabs, respectively.

15. The kit of claim 13 further comprising:

at least one divider having at least one spindle positioned on each of opposing sides thereof the divider.

16. A container for dispensing material from a roll comprising a core defining an internal passage, the container comprising:

a base;

a lid coupled to the base;

at least one divider removably engaged with the base, the divider comprising:

a wall; and at least one spindle extending from the wall and adapted to extend in the internal passage defined by the core of the roll;

an open position; and a closed position in which:

a cavity is defined by the base and the lid;

a gap is defined between the lid and the base, wherein the material is adapted to be dispensed from the roll through the gap; and the divider contacts the lid, wherein the contact between the divider and the lid is adapted to resist any sliding of the material over the divider.

17. The container of claim 16 wherein the base comprises:

a first plurality of grooves; and a second plurality of grooves facing the first plurality of grooves;

wherein the at least one divider is removably engaged within facing ones of the first and second pluralities of grooves.

18. The container of claim 16 wherein the spindle is adapted to suspend the roll of material within the cavity defined by the base and the lid so that the roll of material is permitted to rotate in place when the material is dispensed from the roll of material.

19. The container of claim 16 wherein the material is adapted to be dispensed through the gap in a first direction; and wherein the at least one divider at least partially defines a portion of the gap to which movement of the material in a second direction generally transverse to the first direction is adapted to be limited when the material is being dispensed from the roll of material.

20. The container of claim 16 wherein the at least one divider is symmetric about at least one plane.

21. A container for dispensing material from a roll comprising a core defining an internal passage, the container comprising:

a bottom member and a top member attached to the bottom member for pivotal movement about an axis, the bottom and top members defining a cavity having a generally cylindrical shape, the bottom member comprising:

first and second walls extending generally parallel to the axis, a shelf extending from the second wall in a plane generally perpendicular to the second wall and generally parallel to the axis, a first plurality of grooves defined on the first wall, and a second plurality of grooves defined on the second wall, the top member comprising:

a lip extending over a portion of the shelf;

at least one divider disposed within the cavity and engaged within facing ones of the first and second pluralities of grooves, the at least one divider extending between the first and second walls generally perpendicular to the axis, the at least one divider comprising:

a projection extending from the divider over at least a portion of the shelf and comprising:

a top edge in contact with at least a portion of the lip, and a bottom edge in contact with the shelf;

and at least one spindle extending from the divider generally parallel to the axis, the spindle being adapted to extend within the internal passage defined by the core of the roll;

wherein the spindle suspends the roll within the cavity defined by the bottom member and the top member so that the roll is permitted to rotate in place when the material is dispensed from the roll.

22. A container for dispensing material from a roll, the container comprising:

a bottom member;

a top member attached to the bottom member for pivotal movement about an axis; and a plurality of dividers disposed within the cavity and spaced in a parallel relation, each of the dividers:

extending generally perpendicular to the axis, and being removably engaged with the bottom member at at least first and second locations on the bottom member, at least a portion of the first location facing at least a portion of the second location across at least a portion of the bottom member;

the bottom and top members defining a cavity having a generally cylindrical shape, the bottom member comprising:

a shelf extending in a plane generally perpendicular to each of the dividers and generally parallel to the axis, the top member comprising a lip extending over a portion of the shelf;

a gap being defined between the top member and the portion of the shelf;

the roll being adapted to be disposed in the cavity and between two of the dividers; and each of the dividers removably engaging the bottom member at the first and second locations in response to relative movement between the divider and the bottom member in a direction generally perpendicular to the plane in which the shelf extends.

* * * * *